US005157215A

United States Patent [19]

Nakae et al.

[11] Patent Number: 5,157,215

[45] Date of Patent: Oct. 20, 1992

[54] ELECTRONIC MUSICAL INSTRUMENT FOR MODULATING MUSICAL TONE SIGNAL WITH VOICE

[75] Inventors: Tetsuichi Nakae; Takashi Matsuda, both of Oome, Japan

[73] Assignee: Casio Computer Co., Ltd., Tokyo, Japan

[21] Appl. No.: 583,966

[22] Filed: Sep. 14, 1990

[30] Foreign Application Priority Data

Sep. 20, 1989 [JP] Japan ..... 1-243676
Dec. 19, 1989 [JP] Japan ..... 1-146870[U]
Aug. 10, 1990 [JP] Japan ..... 2-212699

[51] Int. Cl.[5] ..... G10G 1/00; G10H 7/00; G10H 1/12

[52] U.S. Cl. ..... 84/624; 84/DIG. 9; 84/DIG. 11; 84/625; 84/634

[58] Field of Search ..... 84/624, 625, 694, 695, 84/697, 699, DIG. 11, 622, 645, 634, 659, 660, 661, 666, 672, 673, 696, 712, DIG. 9

[56] References Cited

U.S. PATENT DOCUMENTS 3,999,456 12/1976 Tsunoo et al. ..... 84/681
4,193,332 3/1980 Richardson ..... 84/698
4,265,157 5/1981 Fricke et al. ..... 84/695
4,276,802 7/1981 Mieda ..... 84/700
4,633,748 1/1987 Takashima et al. ..... 84/616
4,698,842 10/1987 Mackie et al. ..... 84/622
4,771,671 9/1988 Hoff, Jr. ..... 84/645
4,945,805 8/1990 Hour ..... 84/697

FOREIGN PATENT DOCUMENTS 57-51994 3/1982 Japan .
60-26091 2/1985 Japan .

*Primary Examiner*—William M. Shoop, Jr.
*Assistant Examiner*—Helen Kim
*Attorney, Agent, or Firm*—Frishauf, Holtz, Goodman & Woodward

[57] ABSTRACT

An electrical musical instrument includes a scale designator for sequentially and automatically designating a scale on the basis of prestored data of a music piece, and a musical tone signal generator for outputting a musical tone signal including a harmonic frequency on the basis of the scale designated by said scale designator or as a fundamental frequency. A voice detector detects an external voice and the detected voice is divided by a modulator into voice signals in a plurality of frequency ranges. The musical tone signal is modulated in units of corresponding frequency ranges on the basis of the voice signals divided into the plurality of frequency ranges.

34 Claims, 19 Drawing Sheets $$S(n)=\frac{1}{4}(x(n)-2x(n-1)+x(n-2))$$

p(n) p(n-1) p(n-2)

$$H1(z)=\frac{1}{4}(1-2Z^{-1}+Z^{-2})$$

$$|H_1(e^{j\Omega})|^2=\frac{1}{16}(6+2\cos 2\Omega-8\cos\Omega)$$

ELECTRONIC MUSICAL INSTRUMENT FOR MODULATING MUSICAL TONE SIGNAL WITH VOICE

BACKGROUND OF THE INVENTION

1. Field of the Invention

The present invention relates to a voice-modulation electronic musical instrument for modulating a musical tone signal with an external voice to generate a musical tone in a tone color similar to the external voice.

2. Description of the Related Art

A conventional electronic musical instrument generates musical tones on the basis of pitches designated by performance operation members such as a keyboard, and tone colors designated by, e.g., tone color selection switches.

A musical instrument which sequentially stores pitches to be designated in advance in a storage means and sequentially reads out the pitch data to perform an automatic performance has been proposed. In either case, a tone color of a generated musical tone is uniquely determined by tone color data designated by a switch in advance. In order to change the tone color during a performance, the switch operation must be performed again. In this case, a tone color of a musical tone can only be changed within a range of preset tone colors, but cannot be changed at a user's will. In addition, it is troublesome to perform such a tone color change operation during a performance. In this manner, if a user can desirably vary a tone color of a musical tone to be generated at his or her own will even during a performance, he or she can more enjoy to play an electronic musical instrument, and can find lots of fun from it.

SUMMARY OF THE INVENTION

The present invention has been made in consideration of the above situation, and has as its object to provide a voice-modulation electronic musical instrument with which a user can be concerned in a change in tone color of a musical tone to be generated so as to desirably vary a tone color of a musical tone, and to give fun like toys.

According to an aspect of the present invention, there is provided an automatic performance apparatus comprising scale designation means for sequentially and automatically designating a scale on the basis of prestored data of a music piece, musical tone signal generation means for outputting a musical tone signal including a harmonic frequency on the basis of the scale designated by the scale designation means as a fundamental frequency, external voice detection means for detecting an external voice, and modulation means for dividing the voice signal from the external voice detection means into voice signals in a plurality of frequency ranges, and modulating the musical tone signal in units of corresponding frequency ranges on the basis of the voice signals divided into the plurality of frequency ranges.

With the above arrangement, a musical tone to be generated can have a tone color similar to an external voice. In addition, since a scale of a musical tone has a fundamental frequency of a designated scale, an interval will never be out of scale.

It is another object of the present invention to provide an automatic performance apparatus with which a user can be readily concerned in an automatic performance, and which can give fun like toys.

According to another aspect of the present invention, there is provided an automatic performance apparatus comprising musical tone signal generation means for sequentially and automatically outputting musical tone signals according to data of a music piece stored in advance, external voice detection means for detecting an external voice, and modulation means for modulating the musical tone signals from the musical tone signal generation means on the basis of the voice signal from the external voice detection means and outputting the modulated musical tone signals.

With this arrangement, a musical tone to be generated is changed in response to an external voice, and a user need only sing with an automatically played musical accompaniment to generate interesting musical tones.

It is still another object of the present invention to provide an electronic musical instrument which can generate a musical tone in a tone color similar to an external voice, and can generate a musical tone signal which leaves a nuance of a tone color unique to the musical tone.

According to still another aspect of the present invention, there is provided an electronic musical instrument comprising scale designation means for designating a scale, musical tone signal generation means for simultaneously outputting a first musical tone signal including a harmonic frequency in a wide frequency range, and a second musical tone signal including only a harmonic frequency in a specific frequency range using the scale designated by the scale designation means as a fundamental frequency, external voice detection means for detecting an external voice, first modulation means for modulating the first musical tone signal on the basis of voice signals obtained by dividing the voice signal from the external voice detection means into a plurality of frequency ranges in units of frequency ranges, and outputting the modulated first musical tone signal, second modulation means for modulating the second musical tone signal output from the musical tone signal generation means on the basis of the voice signal from the external tone detection means, and tone generation means for generating an actual tone based on a signal obtained by mixing the musical tone signals modulated by the first and second modulation means.

With this arrangement, a musical tone which leaves a nuance of a tone color unique to a musical instrument but is similar to a voice can be generated like a "musical tone like a tone having a nuance of a piano tone".

It is still another object of the present invention to provide an electronic musical instrument which can generate a musical tone having a tone color similar to an external voice and leaving a nuance of a tone color unique to the musical tone with a simple arrangement.

According to still another aspect of the present invention, there is provided an electronic musical instrument comprising:

scale designation means for designating a scale;

musical tone signal generation means for simultaneously outputting a first musical tone signal including a harmonic frequency in a wide frequency range and a second musical tone signal including only a harmonic frequency in a specific frequency range on the basis of the scale designated by the scale designation means as a fundamental frequency;

first mixer means for mixing the first and second musical tone signals, and outputting the mixed signal;

external voice detection means for detecting an external voice;

modulation means for dividing the voice signal from the external voice detection means into voice signals in units of a plurality of frequency ranges, modulating the musical tone signal mixed by the first mixer means in units of the corresponding frequency ranges on the basis of the divided voice signals in the plurality of frequency ranges, and outputting the modulated signals;

tone generation means for generating a tone on the basis of the musical tone signal modulated by the modulation means.

With this arrangement, the first and second musical tone signals are mixed in advance, and the mixed signal is modulated based on an external voice, so that modulation of the first and second musical tone signals can be performed by a single modulation means. Thus, an electronic musical instrument which can generate a "musical tone like a tone having a nuance of a piano tone" can be realized at low cost.

It is still another object of the present invention to provide an electronic musical instrument which modulates a musical tone to be generated according to a nuance of a voice of a user, and has a small circuit size, a high S/N ratio, and is free from a change over time and a variation in performance in mass production.

More specifically, according to still another aspect of the present invention, there is provided an electronic musical instrument comprising:

first digital filtering processing means for dividing a digital musical tone signal into musical tone signals which are frequency-range limited to a plurality of different frequency ranges;

second digital filtering processing means for dividing a digital voice signal into voice signals which are frequency-range limited to a plurality of different frequency ranges;

envelope extraction processing means for extracting envelope signals from the frequency-range limited voice signals obtained by the second digital filtering processing means;

modulation processing means for modulating the frequency-range limited musical tone signals obtained by the first digital filtering processing means according to the envelope signals obtained by the envelope extraction processing means; and accumulation processing means for accumulating the modulated signals obtained by the modulation processing means and outputting an accumulated signal as a digital output musical tone signal.

According to this arrangement, an electronic musical instrument which can add a nuance of voice to a musical tone can be constituted by digital circuits, thus increasing an S/N ratio and eliminating a change over time and a variation in performance in mass production.

It is still another object of the present invention to provide an electronic musical instrument which modulates musical tones having intervals given by a performance in accordance with a nuance of a voice of a user during the performance and produces the modulated tones, and which has a small circuit size, a high S/N ratio, and is free from a change over time and a variation in performance in mass production.

According to still another aspect of the present invention, there is provided an electronic musical instrument comprising:

musical tone signal generation means for generating a digital musical tone signal on the basis of a performance operation by a user;

voice signal generation means for generating a digital voice signal on the basis of a voice produced by a user;

digital signal processing means for sequentially executing first digital filtering processing for dividing the digital musical tone signal into musical tone signals which are frequency-range limited to a plurality of different frequency ranges, second digital filtering processing for dividing the digital voice signal into voice signals which are frequency-range limited to a plurality of different frequency ranges, envelope extraction processing for extracting envelope signals from the frequency-range limited voice signals obtained by the second digital filtering processing, modulation processing for modulating the frequency-range limited musical tone signals obtained by the first digital filtering processing according to the envelope signals obtained by the envelope extraction processing, and accumulation processing for accumulating the modulated signals obtained by the modulation processing and outputting an accumulated signal as a digital output musical tone signal by time-divisional digital signal processing;

sound producing means for converting the digital output musical tone signal output from the digital signal processing means into an analog output musical tone signal and producing a corresponding sound.

According to this arrangement, an electronic musical instrument which can add a nuance of a human voice to a musical instrument tone can be constituted by digital circuits, thus increasing an S/N ratio and eliminating a change over time and a variation in performance in mass production.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

Other objects and features of the present invention will be apparent to those who are skilled in the art from a description of the preferred embodiments taken in conjunction with the accompanying drawings, in which.

DETAILED DESCRIPTION OF THE PREFERRED EMBODIMENT

The preferred embodiments of the present invention will be described below with reference to the accompanying drawings.

Figure 1:
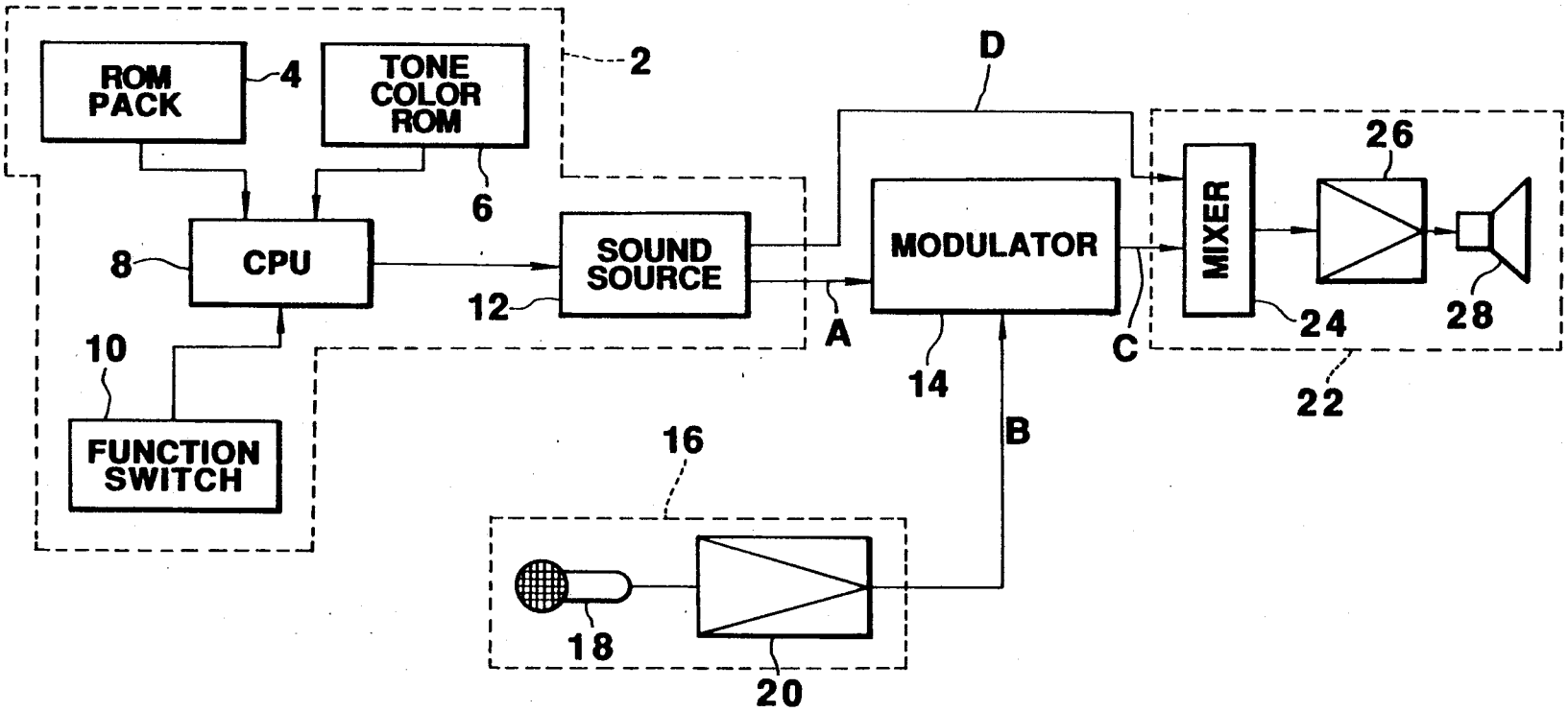
FIG. 1 is a block diagram of an automatic performance apparatus according to an embodiment of the present invention.

FIG. 1 is a block diagram of an automatic performance apparatus according to an embodiment of the present invention. In FIG. 1, a musical tone signal generator 2 comprises a detachable ROM pack 4 for storing note data; a tone color ROM 6 for storing tone waveform data and envelope data; a CPU 8 for sequentially reading out data from the ROM pack 4 and the tone color ROM 6 and sequentially outputting musical tone data necessary for a certain music piece; a function switch 10 for externally controlling, e.g., start of an operation of the CPU 8; and a sound source 12 for generating musical tones on the basis of musical tone data from the CPU 8. In this embodiment, the musical tone signal generator 2 simultaneously outputs a melody tone signal and an accompaniment tone signal of a certain music piece as the musical tone signal. The ROM pack 4 and the tone color ROM 6 store both melody and accompaniment tone data.

Of these two signals, the melody tone signal is input to a modulator 14 via a signal line A. The modulator 14 also receives an external voice signal from an external voice detector 16 via a signal line B. In this embodiment, the external voice signal detector 16 comprises a microphone 18 and an amplifier 20, and detects a voice of a user. The modulator 14 modulates the melody tone signal with the external voice signal, and supplies the modulated signal to a tone generator 22 via a signal line C. The tone generator 22 comprises: a mixer 24 for mixing the signals from the modulator 14 and the accompaniment tone signal input through a signal line D; an amplifier 26 for amplifying an output signal from the mixer 24; and a loudspeaker 28 for producing a sound in response to the output signal from the amplifier 26.

Figure 2:
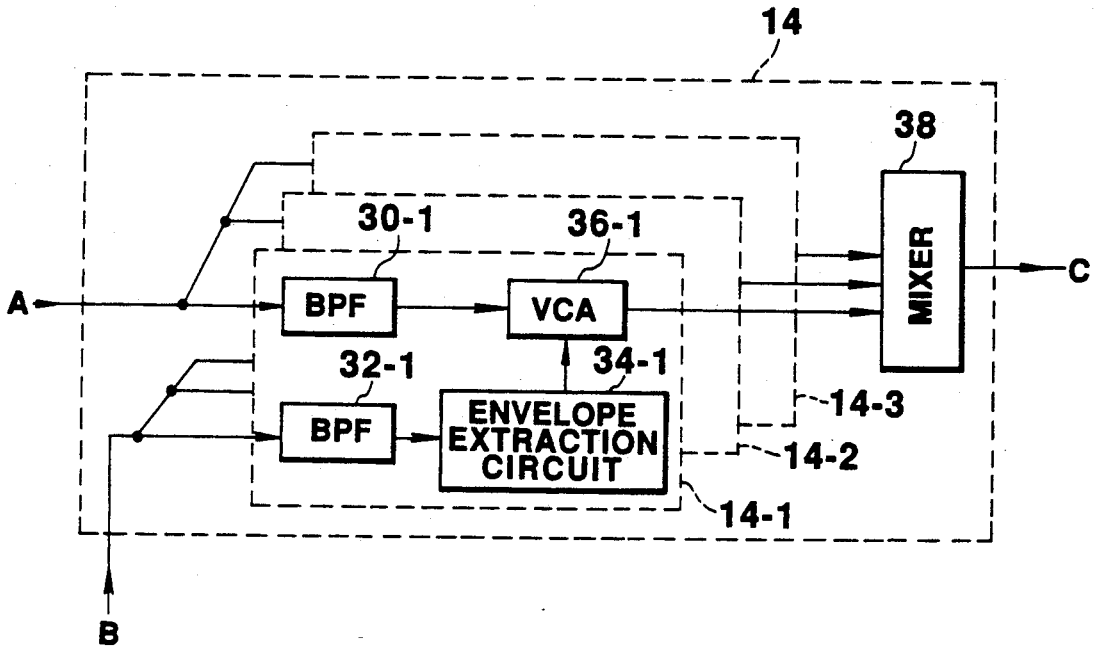
FIG. 2 is a detailed circuit diagram of a modulator shown in FIG. 1.
Figure 3A:
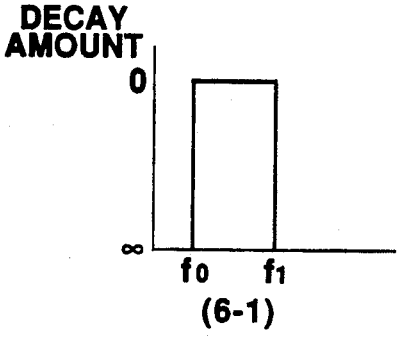
FIG. 3A, 3B, 3C, and 3D are graphs showing characteristics of band-pass filters arranged in a frequency-range modulation circuit.
Figure 3B:
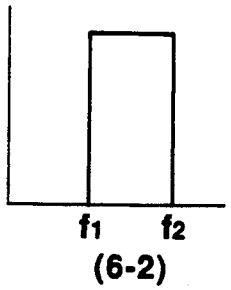
Figure 3C:
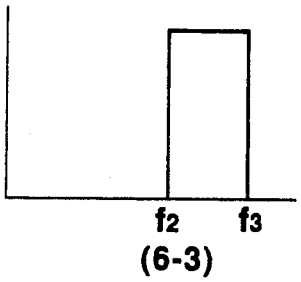
Figure 3D:
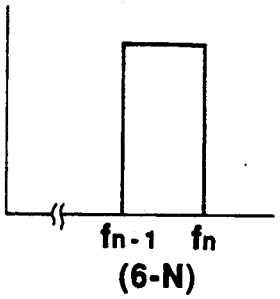

FIG. 2 is a detailed circuit diagram of the modulator 14 shown in FIG. 1. In FIG. 2, the modulator 14 comprises a plurality of frequency-range modulation circuits 14-1, 14-2,... having the same arrangement. The frequency-range modulation circuit 14-1 comprises a band-pass filter (to be abbreviated to as a BPF hereinafter) 30-1 for receiving the melody tone signal, and a BPF 32-1 for receiving the external voice signal. The BPFs 30-1 and 32-1 have the same constant, and allow signals in the same frequency range to pass therethrough. The BPF 32-1 is connected to a envelope extraction circuit 34-1 for extracting only an envelope signal component of an input signal. The BPF 30-1 is connected to a voltage-controlled amplifier (to be abbreviated to as a VCA hereinafter) 36-1. The control terminal of the VCA 36-1 is connected to the BPF 32-1, and the VCA 36-1 varies a signal level from the BPF 30-1 in correspondence with a signal level from the BPF 32-1.

Although other frequency-range modulation circuits 14-2, 14-3, ... have substantially the same arrangement, BPFs 30 and 32 have different constants in units of frequency-range modulation circuits. The frequency-range modulation circuits 14-1, 14-2, ... allow the melody tone signals and the external voice signals which are divided into different frequency ranges to pass therethrough, and modulate corresponding signals, as shown in FIGS. 3A to 3D. The output signals from these frequency-range modulation circuits 14-1, 14-2, ... are mixed and output by a mixer 38.

The operation of this circuit will be described below.

The musical tone signal generator 2 independently outputs a melody tone signal and an accompaniment tone signal in a predetermined sequence. Only the melody tone signal is input to the modulator 14. When a user sings with accompaniment tones, the voice signal is also input to the modulator 14. The input melody tone signal and the external voice signal are divided into signals in units of frequency ranges by the BPFs 30 and 32 in the frequency range modulation circuits. The divided external voice signals are input to the corresponding envelope extraction circuits 34, and only envelope signals are extracted. The VCAs 36 vary levels of the melody tone signals which are input in correspondence with the levels of the extracted envelope signals, and output the varied signals. In this manner, the melody tone signals which are modulated based on the external tone signal levels in units of frequency ranges are generated, and are input to the mixer 38 to be mixed. The mixed signal is then supplied to the tone generator 22.

As a result, a nuance of an external voice is added to a harmonic component of a melody tone generated by the tone generator 22. For this reason, a melody tone similar to an external voice is generated, and sounds as if the automatic performance apparatus sang in a human voice, resulting in much fun.

Figure 4:
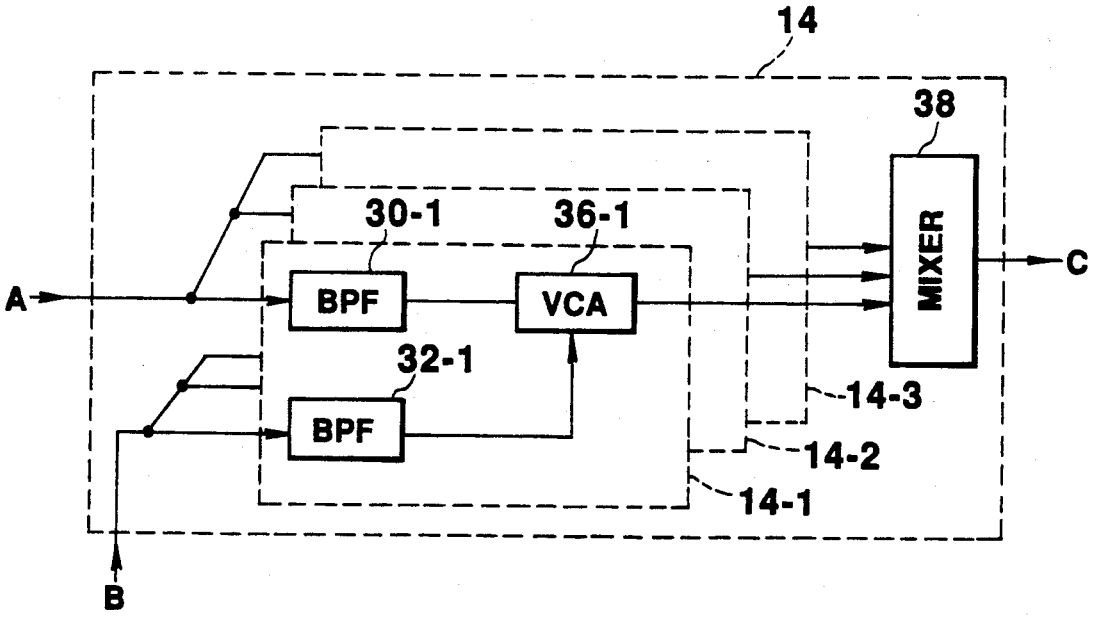
FIG. 4 is a circuit diagram showing another arrangement of the modulator shown in FIG. 1.

FIG. 4 is a circuit diagram showing another arrangement of the modulator 14. The same reference numerals in FIG. 4 denote the same parts as in FIG. 2, and a detailed description thereof will be omitted.

A difference from FIG. 2 is that each BPF 3 for receiving an external voice signal is directly connected to the corresponding VCA 36. In the arrangement shown in FIG. 4, a signal level of a melody tone signal input to the VCA 36 is changed in correspondence with an external voice signal. Thus, a harmonic component of a melody tone is faithfully varied according to an external voice signal, thus generating an interesting melody tone.

Figure 5:
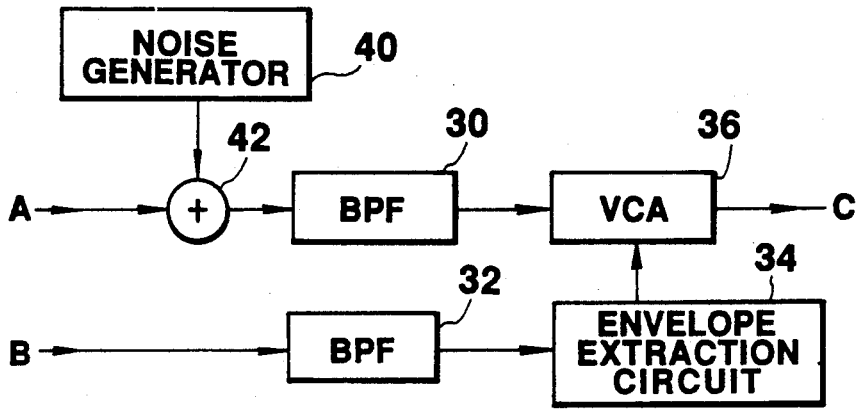
FIG. 5 is a circuit diagram showing another arrangement of the frequency-range modulation circuit shown in FIG. 2.

FIG. 5 is a circuit diagram showing another arrangement of the frequency-range modulation circuit shown in FIG. 2. The feature of this figure is that an adder 42 for adding a white noise signal from a white noise generator 40 to an input melody tone signal is added to the BPF 30. Thus, the melody tone signal can include more harmonic components. Therefore, a problem that a harmonic component included in an external voice signal is not included in a melody tone signal, and a nuance of an external voice cannot be provided to a melody tone, can be solved.

In each of the above embodiments, signal levels of harmonic components of a melody tone are varied in correspondence with changes in signal level in units of frequency ranges of an external voice signal to provide a nuance of a voice to a melody tone. However, the present invention is not limited to this. For example, the VCA 36 may be replaced with a voltage-controlled oscillator (VCO) or a voltage-controlled filter (VCF). The BPFs 30 and 32 in one modulation circuit have the same characteristics but may have different characteristics. In this case, more interesting melody tones can be generated as compared to a case wherein a signal level is varied in correspondence with an external voice signal.

Figure 6:
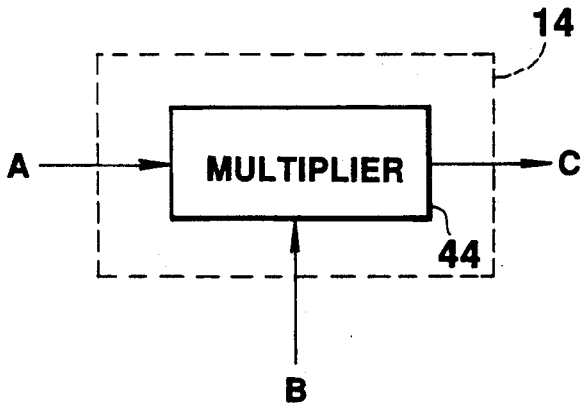
FIG. 6 is a circuit diagram showing still another arrangement of the modulator shown in FIG. 1.

FIG. 6 is a circuit diagram showing still another arrangement of the modulator 14. In FIG. 6, the modulator 14 comprises a multiplier 44 for multiplying a melody tone signal and an external voice signal. With this circuit, a signal input to the tone generator 22 corresponds to a product of a melody tone and an external voice, thus generating a unique melody tone corresponding to an external voice.

Figure 7:
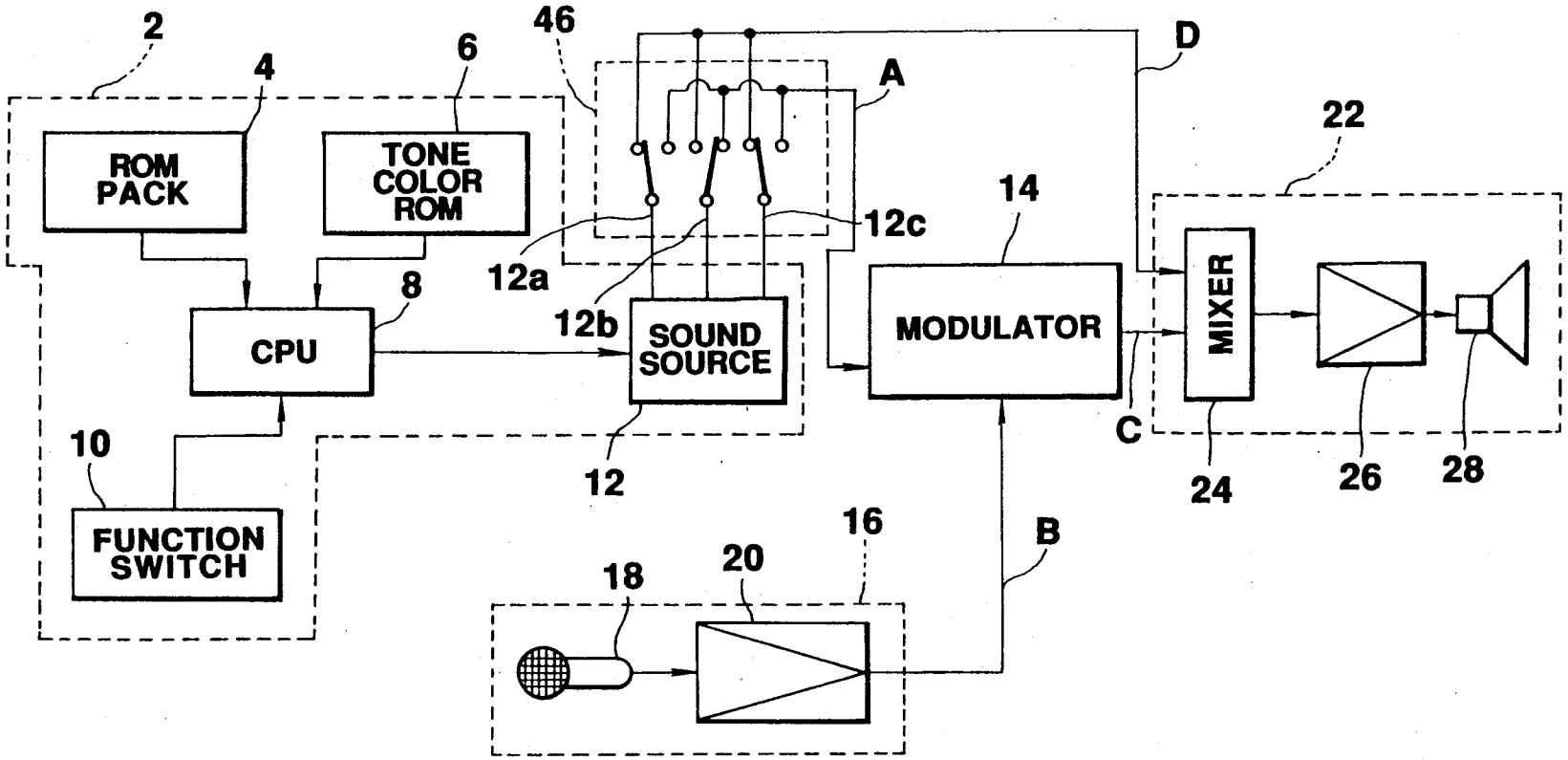
FIG. 7 is a block diagram showing an automatic performance apparatus according to another embodiment of the present invention.

FIG. 7 is a block diagram showing another embodiment of an automatic performance apparatus according to the present invention. The same reference numerals in FIG. 7 denote the same parts as in FIG. 1, and a detailed description thereof will be omitted.

The characteristic feature of FIG. 7 is that a selector 46 is arranged. The selector 46 selects which ones of a melody tone signal and accompaniment tone signals such as chord tones or obbligato tones are to be modulated using a voice signal. In FIG. 7, a sound source 12 has output terminals 12*a*, 12*b*, and 12*c*. The output terminal 12*a* outputs a melody tone signal, the output terminal 12*b* outputs a chord tone signal as an accompaniment tone, and the output terminal 12*c* outputs an obbligato tone signal as an accompaniment tone. When the contact of each output terminal is brought into contact with a signal line A connected to a modulator 14, the corresponding signal is modulated with the external voice signal; when it is brought into contact with a signal line D, the corresponding signal is directly supplied to a tone generator 22. Therefore, when the output terminals 12*a* and 12*b* are connected to the signal line D and the output terminal 12*b* is connected to the signal line A, as shown in FIG. 7, only the chord tone signal as an accompaniment tone is modulated based on the external voice signal.

In this manner, when the contacts in the selector 46 are switched, desired ones of a melody tone, and chord and obbligato tones as accompaniment tones can be modulated with an external voice.

Figure 8:
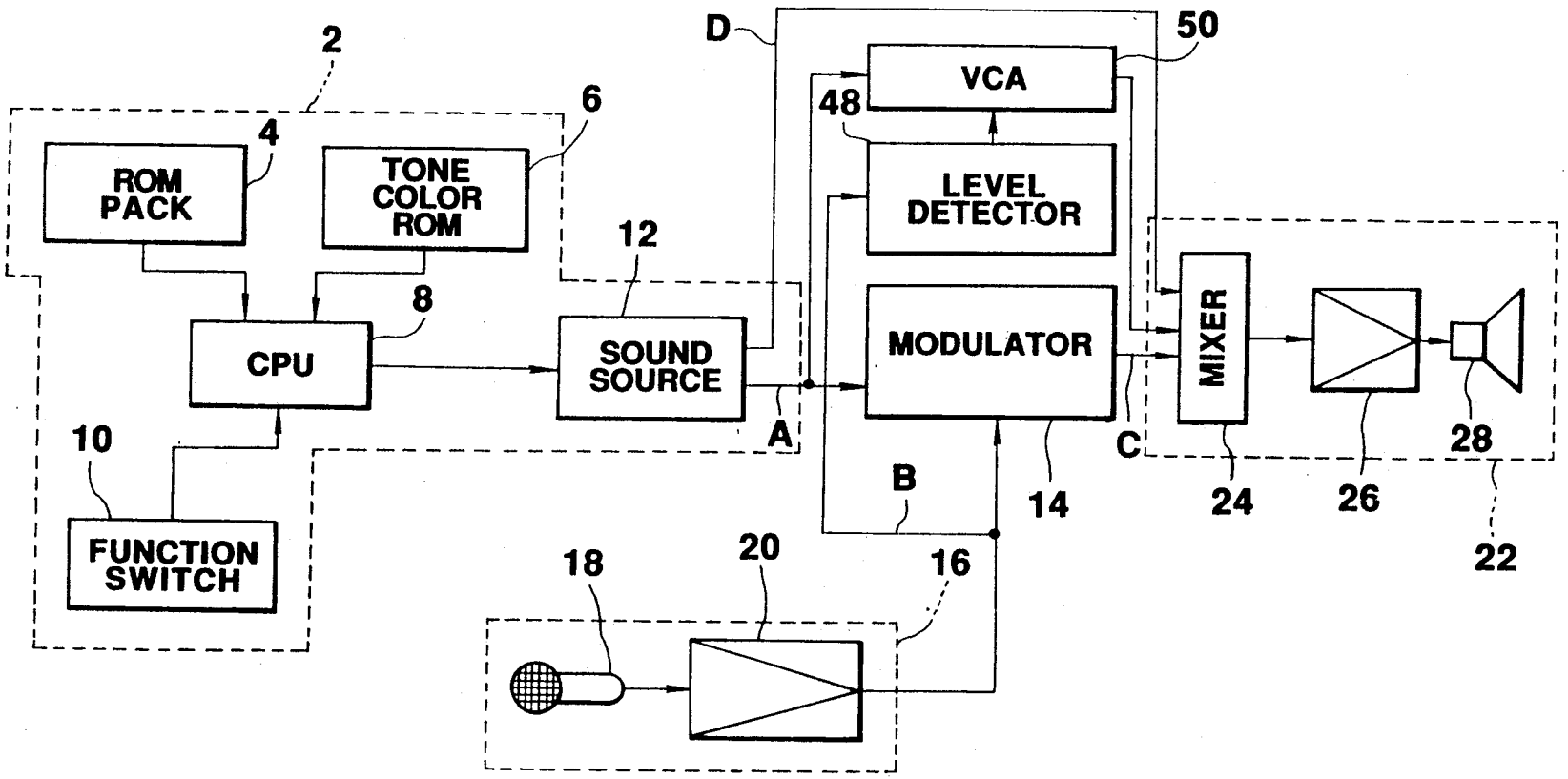
FIG. 8 is a block diagram of an automatic performance apparatus according to still another embodiment of the present invention.

FIG. 8 is a block diagram showing still another embodiment of an automatic performance apparatus according to the present invention. The characteristic feature of this embodiment is as follows. That is, in order to prevent a phenomenon that if no external voice is detected (i.e., if an external voice signal is set to zero level), no melody tone is generated, when the external voice signal is at zero level, a melody tone signal of a given level, which is not modulated, is output. In FIG. 8, a level detector 48 for detecting that the level of an external voice signal from an external voice signal detector 16 becomes zero, and a VCA 50 for receiving a melody tone signal from a sound source signal, and for receiving a signal from the level detector 42 at its control terminal are arranged. Therefore, when an external voice decays, the level detector 48 detects this, and outputs a signal of a given level. The VCA 50 outputs a melody tone signal corresponding to the level of this output signal, and supplies it to a mixer 24 in a tone generator 22.

As a result, when an external voice decays, a melody tone signal will never decay.

If the circuit shown in FIG. 8 is not used, each VCA 36 shown in FIGS. 3 to 6 may be adjusted such that a signal of a given level can be output even if a signal input to the control terminal is at zero level. Thus, a melody tone signal will never decay even if an external voice signal decays.

Figure 9:
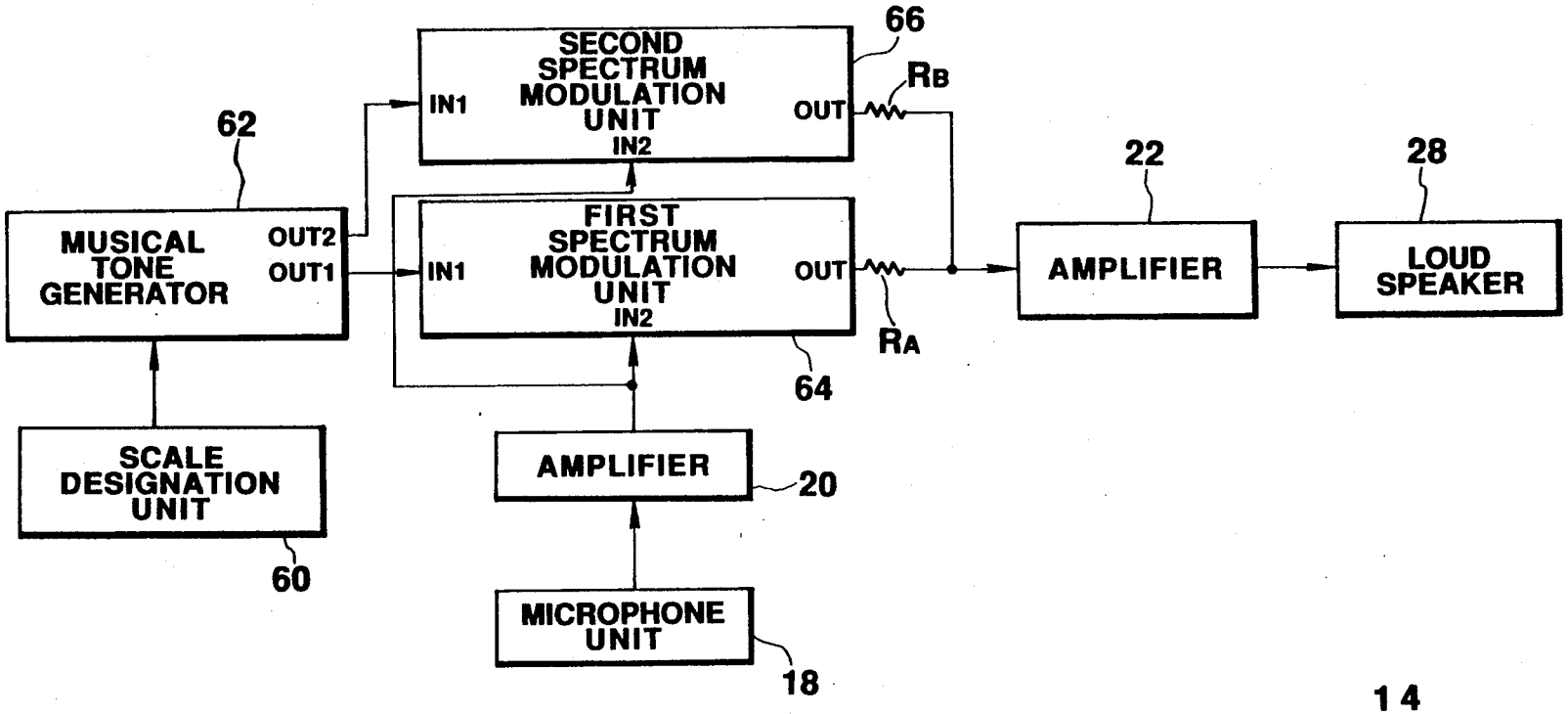
FIG. 9 is a block diagram of an electronic musical instrument according to still another embodiment of the present invention.

FIG. 9 is a block diagram of an electronic musical instrument according to still another embodiment of the present invention.

In the above embodiment, in order to generate a musical tone having a tone color similar to that of an external voice, a musical tone signal and an external voice signal are divided into signals in a plurality of frequency ranges, and modulation is performed in units of divided signals. For this reason, in order to perform modulation based on an external voice, a musical tone signal must have a wide frequency range like an external voice. More specifically, assuming that a musical tone signal consists of only frequency components of $f_0$ to $f_1$ in a frequency range shown in FIG. 3A, even if an external voice signal has frequency ranges of $f_1$ to $f_2$, $f_2$to $f_3$, and $f_{n-1}$ to $f_n$, these frequency ranges of the voice signal cannot be utilized to modulate the musical tone signal.

For this reason, a white noise component is mixed, as shown in FIG. 4, or a musical tone signal having a wide frequency range such as a triangular wave or a rectangular wave is used. As a result, a musical tone in which a nuance of a tone color unique to a musical instrument remains and which is similar to a voice like a "musical tone like a voice having a nuance of a piano tone" cannot be obtained This embodiment is characterized in that a nuance of a tone color unique to a musical instrument is provided to a musical tone modulated with a voice.

In FIG. 9, the electronic musical instrument comprises a scale designation unit 60 for designating a scale upon operation of it, and a musical tone generator 62 for generating a musical tone signal based on the scale designated by the scale designation unit 60. The musical tone generator 62 has two output sections OUT1 and OUT2. The output section OUT1 outputs a first musical tone signal including a harmonic frequency in a wide frequency range, e.g., a musical tone signal consisting of a triangular wave on the basis of the scale designated by the scale designation unit as a fundamental frequency. On the other hand, the output section OUT2 outputs a second musical tone signal including only a harmonic frequency in a specific frequency range, e.g., a musical tone signal consisting of a musical tone waveform of a piano tone on the basis of the designated scale as a fundamental frequency.

The musical tone signal output from the output section OUT1 of the musical tone generator 62 is supplied to an input terminal IN1 of a first spectrum modulation unit 64, and the musical tone signal output from the output section OUT2 is supplied to an input terminal IN1 of a second spectrum modulation unit 66. On the other hand an external voice detected by a microphone unit 18 is amplified by an amplifier 20, and the amplified voice signal is supplied to input terminals IN2 of the first and second spectrum modulation units 64 and 66.

The first and second spectrum modulation units 64 and 66 have the same arrangement as that of the modulator shown in FIG. 2. The signals output from the first and second spectrum modulation units 64 and 66 are mixed by resistors $R_A$ and $R_B$, as shown in FIG. 9, and the mixed signal is amplified by an amplifier 26. The amplified signal is produced as an actual sound from a loudspeaker 28.

In the above arrangement, when a user operates the scale designation unit 60 to designate a proper scale, the musical tone generator 62 outputs, from the output section OUT1, a musical tone signal consisting of a triangular wave including a harmonic frequency in a wide frequency range and o the basis of the scale designated by the scale designation unit 60 as a fundamental frequency. On the other hand, the musical tone generator 62 outputs, from the output section OUT2, a musical tone signal including only a harmonic frequency in a specific frequency range and consisting of a musical tone waveform of a piano tone on the basis of the designated scale as a fundamental frequency. In this case, if a user sings a song at the microphone unit 18, the microphone unit 18 detects an external voice.

The first spectrum modulation unit 64 receives the musical tone signal consisting of the triangular wave from the output section OUT1 of the musical tone generator 62, and the voice signal from the amplifier 20. The input musical tone signal and the voice signal are divided into signals in units of frequency ranges by first and second BPFs 30 and 32 in frequency-range modulation circuits 14-1 to 14-N in the first spectrum modulation unit 64. Only envelope signals are extracted from the divided voice signals by corresponding envelope extraction circuits 34. Each of the VCAs 36 vary levels of input musical tone signals and output the varied signals. Thus, musical tone signals modulated with the external voice signal levels in units of frequency ranges can be generated. These musical tone signals in units of frequency ranges can be mixed by a mixer 38, and the mixed signal is output.

The musical tone signals having the triangular wave, which are divided by the first BPFs 30 include harmonic frequencies in a wide frequency range, and have a wide frequency range like a voice signal. For this reason, the musical tone signals include frequency ranges corresponding to those of voice signals divided by the second BPFs 32. Thus, the divided musical tone signals are modulated with the divided voice signals in units of frequency ranges. The feature of the voice signal can be entirely given to the musical tone signal, and the musical tone signal can be modulated under the strong influence of the musical tone signal.

On the other hand, signals are divided in units of frequency ranges by first and second BPFs 30 and 32 in frequency-range modulation circuits 14-1 to 14-N in the second spectrum modulation unit 66. The musical tone signals consisting of the piano tone waveform, which are divided in units of frequency ranges, are modulated according to levels of envelope signals of an external voice. However, the musical tone signal consisting of the piano tone waveform includes only a harmonic frequency in a specific frequency range. Therefore, even if this musical tone signal is divided by the first BPFs 30, the divided signals do not have frequency ranges corresponding to those of the second BPFs 32 obtained by dividing a voice signal having a wide frequency range.

Therefore, even if the divided musical tone signals are to be modulated in correspondence with signal levels of envelope signals of the voice signal, which are divided into a plurality of frequency ranges, changes in envelope signal level in the respective frequency ranges do not effectively influence modulation of the divided musical tone signals. Therefore, the musical tone signal consisting of the piano tone waveform is not so strongly influenced by the voice signal, and the feature of the musical tone signal as a piano tone remains.

Then, the musical tone signal consisting of a triangular wave and the voice signal are mixed, the mixed signal is amplified by the amplifier 22, and the amplified signal is then produced as an actual sound from the loudspeaker 28. Thereby, a musical tone which can strongly reflect the feature of a voice, and still has a feature of a piano tone can be produced.

Thus, a "musical tone like a voice having a nuance of a piano tone" which cannot be obtained by a conventional electronic musical instrument can be obtained, thus giving fun to a performance.

Figure 10:
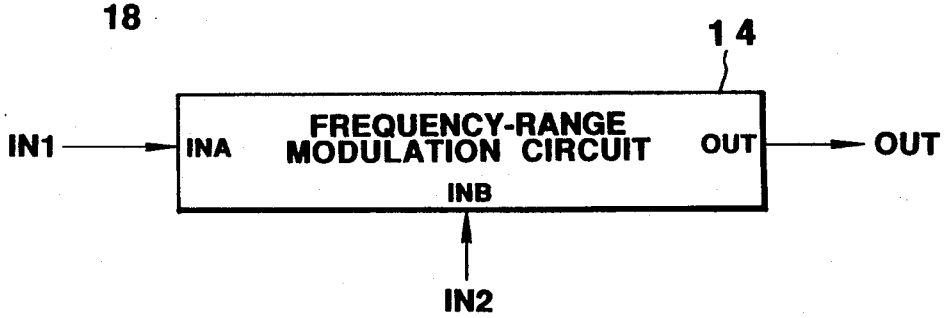
FIG. 10 is a block diagram showing an internal arrangement of a second spectrum modulation unit in still another embodiment of an electronic musical instrument according to the present invention.
Figure 11:
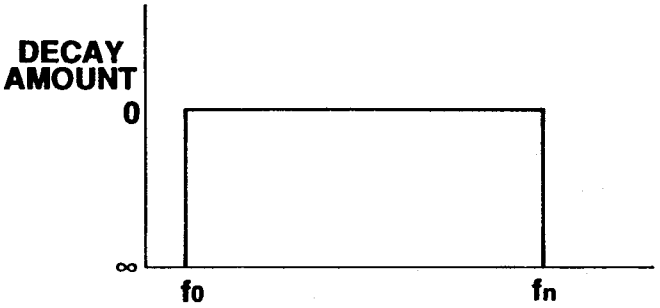
FIG. 11 is a graph showing characteristics of a band-pass filter arranged in a frequency-range modulation circuit of the spectrum modulation unit.

In this embodiment, the first and second spectrum modulation units 64 and 66 have the same arrangement. The second spectrum modulation unit 66 has the same frequency-range modulation circuits 14-1 to 14-N as in the first spectrum modulation unit 64. However, the two spectrum modulation units 64 and 66 need not have the same number of frequency-range modulation circuits 14-1 to 14-N. For example, he second spectrum modulation unit 66 may comprise a single frequency-range modulation circuit 14, as shown in FIG. 10, and the first and second BPFs arranged in this modulation circuit 14 may allow all the frequency components $f_0$ to $f_n$ to pass therethrough, as shown in FIG. 11.

In this case, the second spectrum modulation unit 66 adds an envelope of the entire voice signal to a musical tone signal consisting of a piano tone waveform. As a result, the influence of the external voice on a piano tone is enhanced. Therefore, the second spectrum modulation unit 66 may select various BPFs having different characteristics, so that the influence of an external voice on a piano tone can be changed.

When BPFs having different characteristics are selectively used, if $f_0$ is sufficiently small and $f_n$ is sufficiently large, the BPFs in the second spectrum modulation unit 66 may be omitted.

Figure 12:
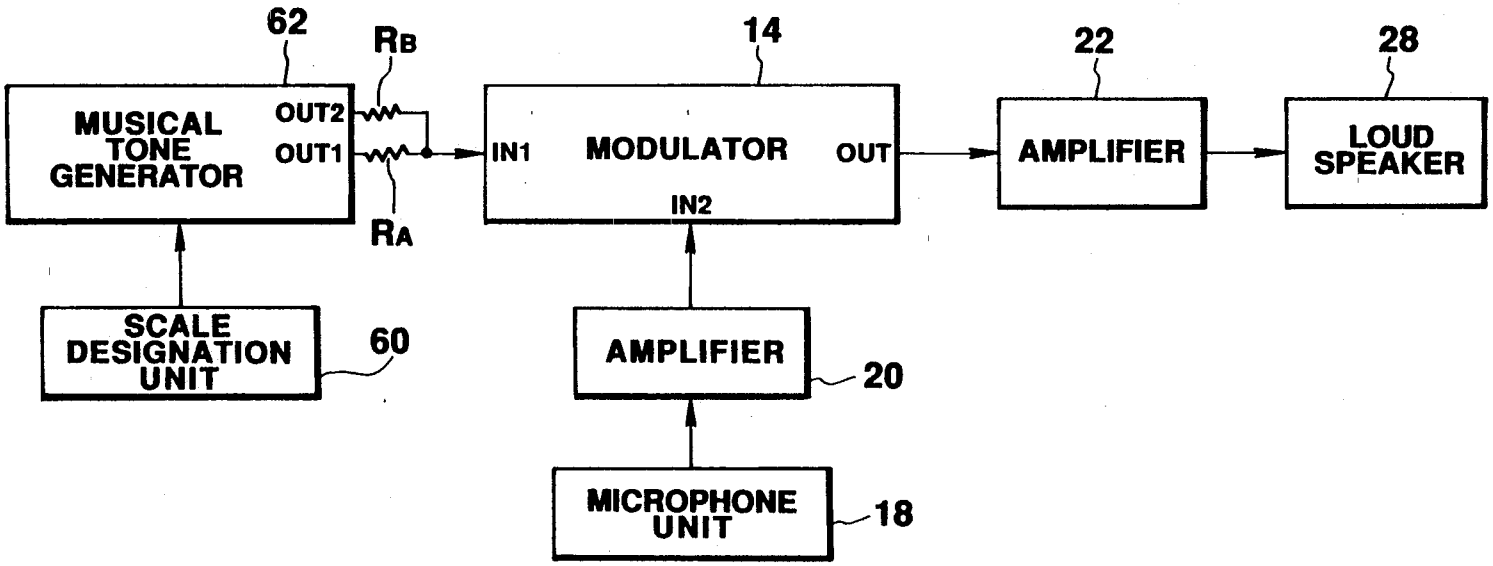
FIG. 12 is a block diagram showing still another embodiment of an electronic musical instrument according to the present invention.

FIG. 12 shows still another embodiment of the present invention. First and second musical tone signals output from output sections OUT1 and OUT2 of a musical tone generator 62 are mixed by resistors $R_A$ and $R_B$ before they are input to a modulator 14. Therefore, the musical tone signal mixed by the resistors $R_A$ and $R_B$ has mixed frequency components of the first and second musical tone signals. The mixed musical tone signal is modulated based on an external voice by the single modulator 14, thereby obtaining a musical tone which remains a nuance of the second musical tone signal like in the above embodiment.

Figure 13:
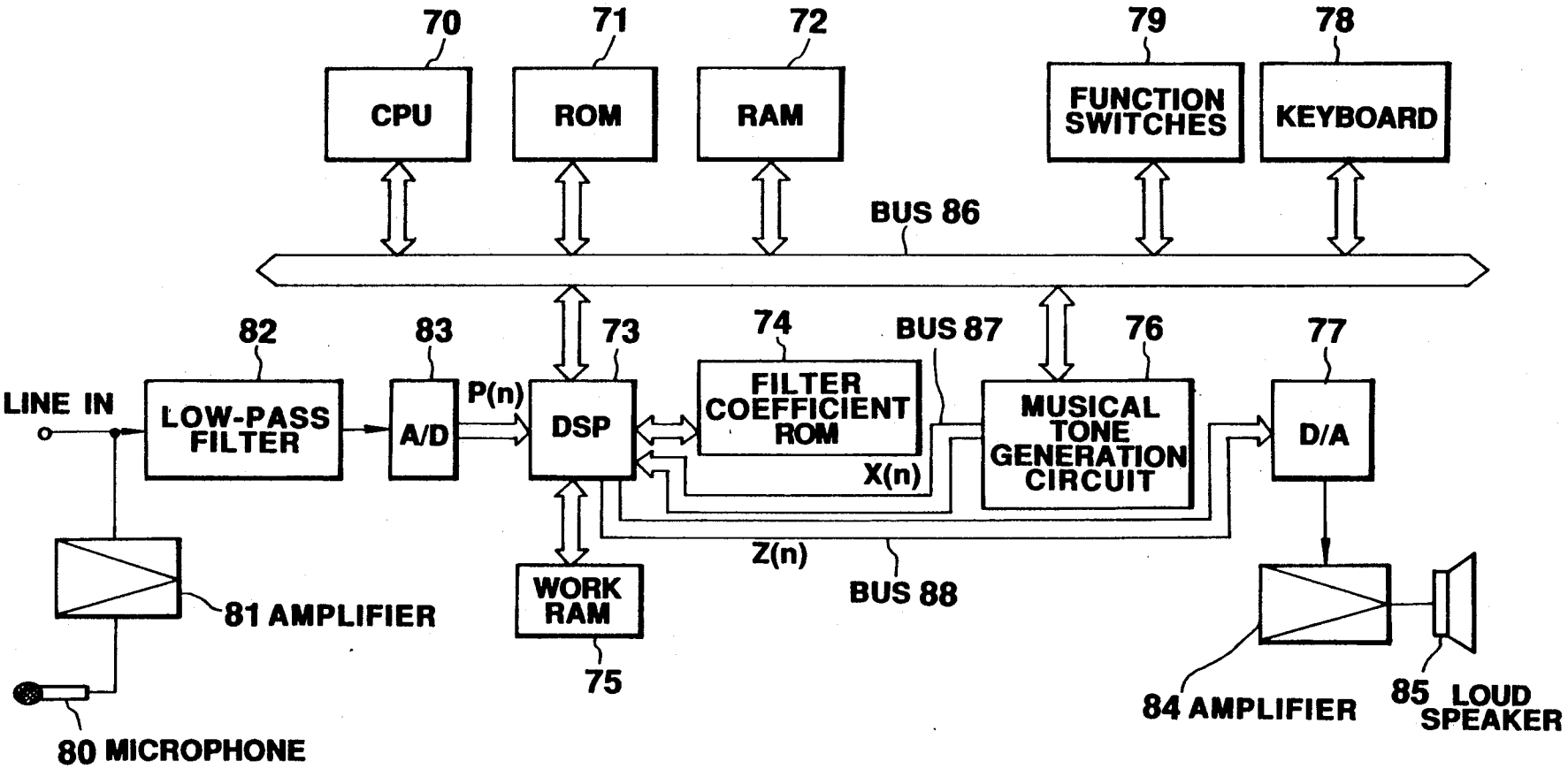
FIG. 13 is a block diagram showing the overall arrangement when a voice-modulation electronic musical instrument according to the present invention is constituted by digital circuits.

FIG. 13 is a block diagram showing the overall arrangement when a voice-modulation electronic musical instrument according to the present invention is constituted by digital circuits.

When a user performs a keyboard operation at a keyboard 78 or performs switch operations for setting, e.g., a tone color or various musical effects using function switches 79, corresponding performance data are sent to a CPU 70 via a bus 86. The CPU 70 executes a program stored in a ROM 71, and performs processing of the performance data while using a RAM 72 as a temporary work memory. The processed performance data, e.g., note-ON/OFF data, velocity data, tone color setup data, and the like are supplied to a musical tone generation circuit 76. The circuit 76 generates musical tones according to the above-mentioned performance data. A musical tone generation method of the circuit 76 can adopt, e.g., a PCM method, a modulation method, a harmonic overtone addition method, or the like.

A digital musical tone signal x(n) generated by the musical tone generation circuit 76 is input to a DSP 73 via a bus 87 exclusively used for a musical tone signal. Meanwhile, when a user produces a voice toward a microphone 80, an analog voice signal obtained via an amplifier 81 is input to an A/D converter 83 via a low-pass filter 82 to be converted into a digital voice signal p(n). The digital voice signal p(n) is input to the DSP 73. Note that the analog voice signal may be input not from the microphone 80 but from a line-in terminal LINE IN.

The operation in the DSP 73 is the characteristic feature of this embodiment. In this embodiment, operations performed in the frequency-range modulation circuits 14-1 to 14-N and the mixer 38 shown in FIG. 2 are realized by digital signal processing. The DSP 73 executes amplitude modulation processing (to be described later) using a filter coefficient ROM 74 for storing various coefficients for digital filtering calculations (to be described later), and a work RAM 75 for storing the digital musical tone signal x(n input from the musical tone generation circuit 76 and the digital voice signal p(n) input from the A/D converter 83, or for storing data for digital filtering calculations.

A digital output musical tone signal z(n) obtained by the amplitude modulation processing in the DSP 73 is supplied to a D/A converter 77 via an exclusive bus 88 to be converted to an analog output musical tone signal. The analog output musical tone signal is amplified by an amplifier 84, and a corresponding sound is then produced from a loudspeaker 85.

Figure 14:
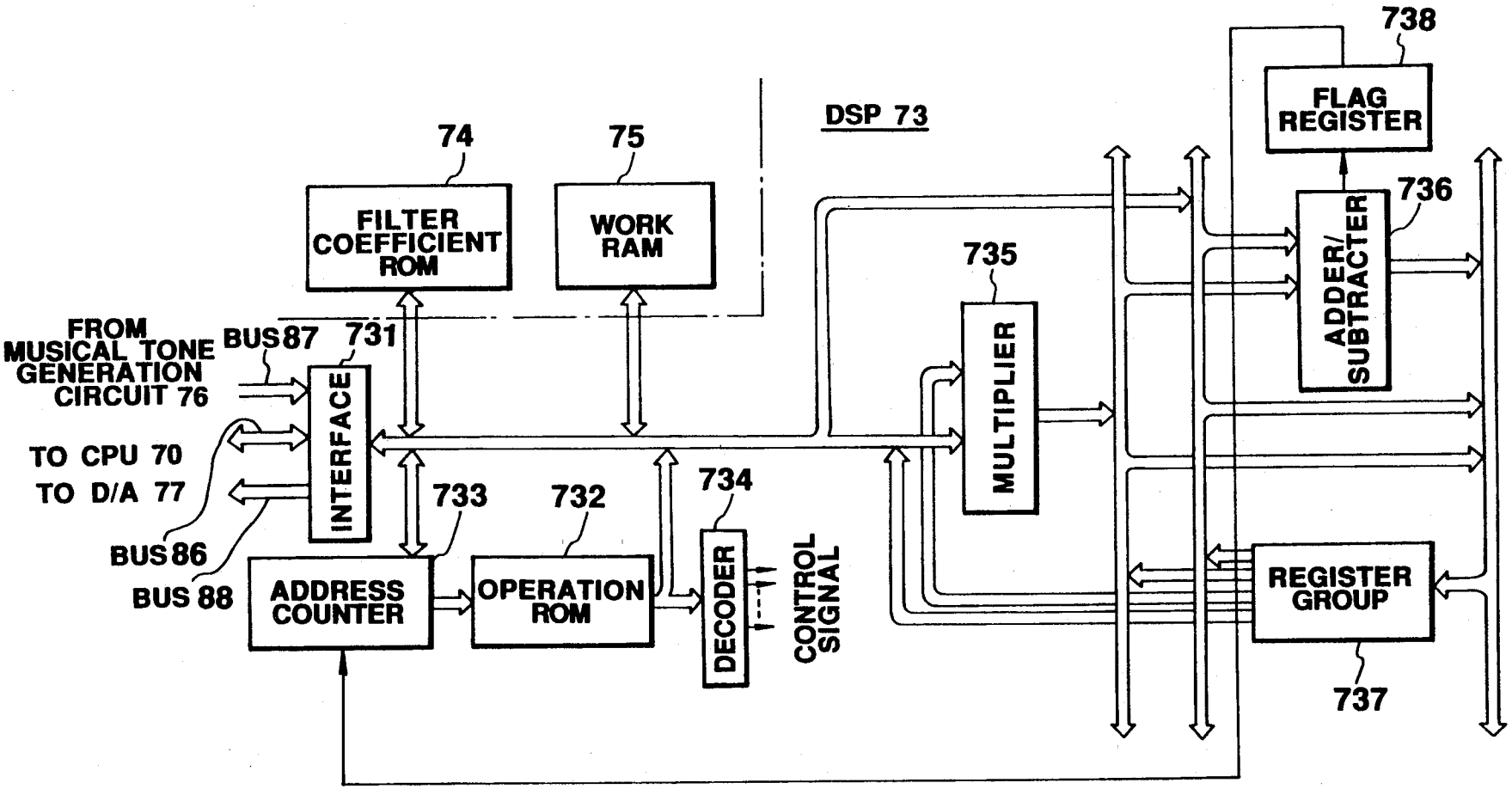
FIG. 14 is a block diagram of a DSP shown in FIG. 13.

FIG. 14 is a block diagram of the DSP 73 shown in FIG. 13.

An interface 731 accommodates the bus 8 connected to the CPU 70, the bus 87 connected to the musical tone generation circuit 76, and the bus 88 connected to the D/A converter 77, and connects these buses with internal circuits.

An operation ROM 732 stores a microprogram for defining the overall operation of the DSP 73. A corresponding program instruction is read out from the operation ROM 732 on the basis of a designated address from an address counter 733. The CPU 70 shown in FIG. 13 sets a given value in the address counter 733 to instruct a program instruction to be read out from the operation ROM 732 and to execute modulation processing (to be described later). The output from the operation ROM 732 is also supplied to a decoder 734, so that various control signals are output to respective circuits in the DSP 73 to cause them to perform desired operations.

An internal bus of the DSP 73 is connected to the filter coefficient ROM 74 and the work RAM 75 shown in FIG. 13, so that filter coefficient data, the digital musical tone signal x(n), the digital voice signal p(n), and the like are properly supplied to the DSP 73 in accordance with the program instruction in the operation ROM 732, or are input/output to/from the work RAM 75.

The DSP 73 further includes a multiplier 735, and an adder/subtracter 736 to perform arithmetic processing. Each of the multiplier 735 and the adder/subtracter 736 is connected to the internal bus to have two inputs and one output. A register group 737 consists of a plurality of registers for storing intermediate calculation data, and the registers are connected to the input and output terminals of the multiplier 735 or the adder/subtracter 736 via the internal bus.

In the DSP 73, in order to perform judge processing according to a calculation result (e.g., a comparison result) from the adder/subtracter 736, a flag signal indicating a "judge" result is sent to the address counter 733 via a flag register 738. An address value of the address counter 733 is appropriately changed in accordance with the output from the flag register 738, and an address-jumped program instruction is read out from the operation ROM 732.

Figure 15:
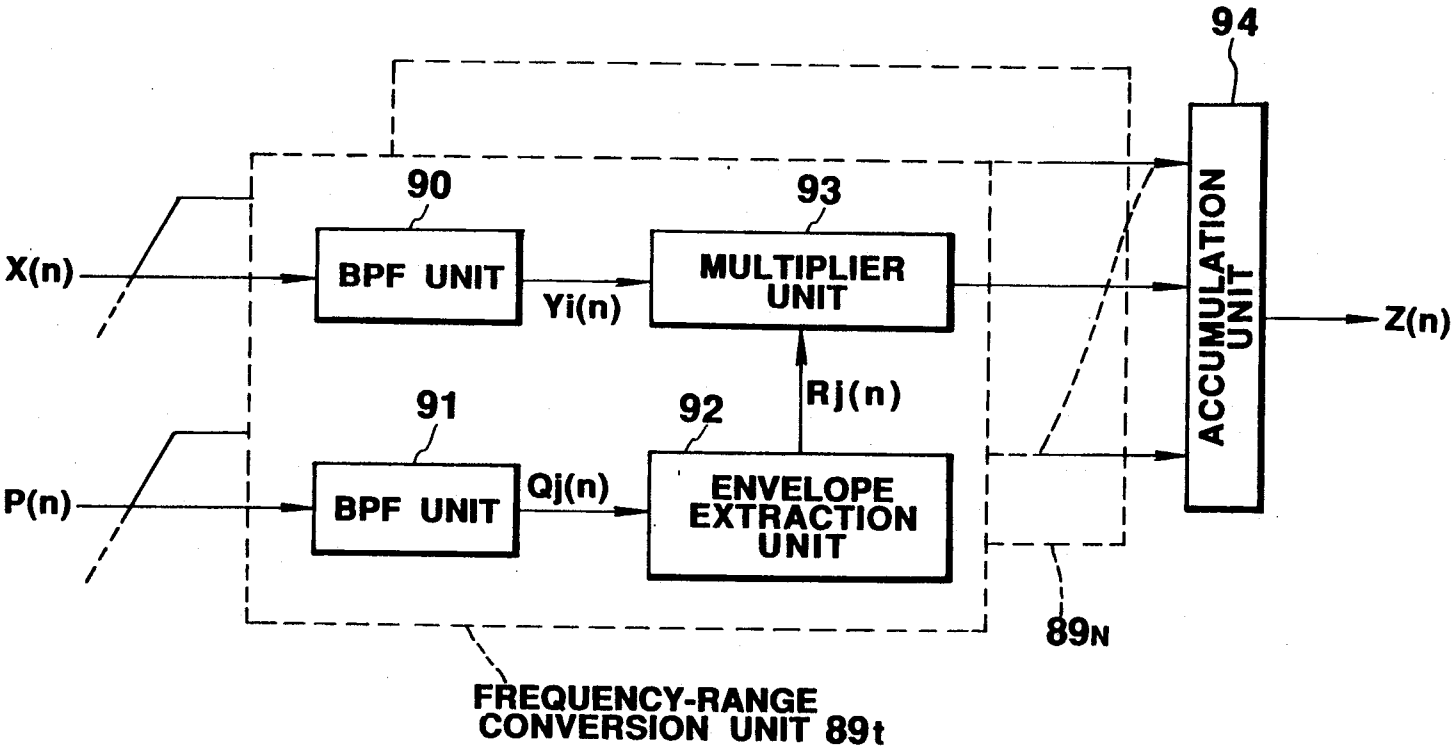
FIG. 15 is a functional block diagram of the DSP in FIG. 13.

FIG. 15 is a functional block diagram of functions realized by the DSP 73.

As shown in FIG. 15, frequency-range conversion units $89_1$, ..., $89_{i=j}$, ..., $89_N$ which have the same functions as those of the frequency-range conversion circuits 14-1 to 14-N shown in FIG. 2 and are realized by time-divisional software processing on the DSP 73 are operated for each sampling period. At the end of each sampling period, the outputs from the conversion units are accumulated by an accumulation unit 94 which is realized by software processing on the DSP 73, and accumulated data is output to the D/A converter 77 shown in FIG. 13 as the digital output musical tone signal z(n).

Each frequency-range conversion unit $89_t$ ($1 \leqq t \leqq N$) comprises band-pass filter units (BPF units) 90 and 91, an envelope extraction unit 92, and a multiplier unit 93. As will be described later, each of the BPF units 90 and 91 is realized by a combination of a high-pass filter formed by software processing common to respective frequency ranges, and a low-pass filter by software processing in units of frequency ranges. As will be described later, the envelope extraction unit 92 is realized by a low-pass filter formed by software processing having a low cut-off frequency. The multiplier unit 93 is realized by product sum arithmetic processing in combination with the accumulation unit 94, as will be described later.

The principle of the detailed arrangement of the BPF units 90 and 91 and the envelope extraction unit 92 shown in FIG. 15 will be described below.

Figure 16:
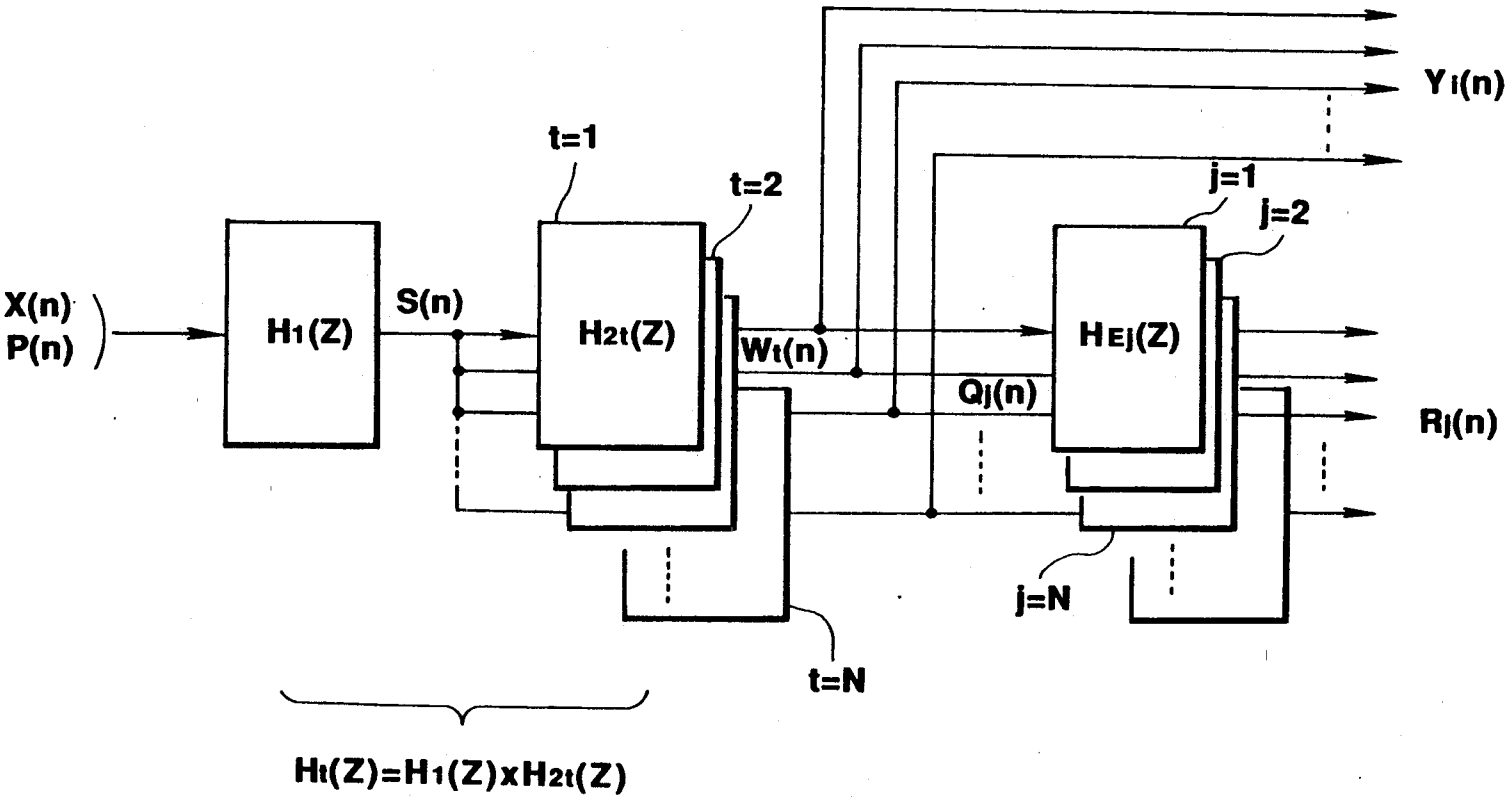
FIG. 16 is a block diagram of a filter in a BPF unit and an envelope extraction unit shown in FIG. 15.

The digital musical tone signal x(n) and the digital voice signal p(n) at each sampling timing n respectively input from the musical tone generation circuit 76 and the A/D converter 83 are subjected to filtering processing in the N BPF units 90 and the N BPF units 91 by the time-divisional processing of the DSP 73. The BPF units 90 and 91 in each frequency-range conversion unit $89_t$ have the same transfer function, and the transfer function is assumed to be represented by $H_t(z)$. In this embodiment, each BPF unit is realized by cascade-connected a high-pass filter unit common to the respective frequency ranges, and a low-pass filter unit in units of frequency ranges. If the transfer function of the high-pass filter unit is represented by $H_1(z)$ and the transfer function of the low-pass filter unit is represented by $H_{2t}(z)$, $H_t(z)$ has a characteristic expressed as a product of $H_1(z)$ and $H_{2t}(z)$, as shown in FIG. 16.

In the case of the BPF unit 90 shown in FIG. 15, the digital musical tone signal x(n) is filtered by the high-pass filter unit having the transfer function $H_1(z)$, and is then filtered by the low-pass filter unit having the transfer function $H_{2t}(z)$. As a result, a digital musical tone signal $Y_t(n)$ (for i=t) subjected to frequency-range limitation is output.

In the case of the BPF unit 91, the digital voice signal p(n) is filtered by the high-pass filter unit having the transfer function $H_1(z)$, and is then filtered by the low-pass filter unit having the transfer function $H_{2t}(z)$. As a result, a digital voice signal $Q_j(n)$ (for j=t) subjected to frequency-range limitation is output. Furthermore, the digital voice signal $Q_j(n)$ is subjected to processing in the envelope extraction unit 92 shown in FIG. 15. This unit is realized by a low-pass filter unit having a transfer function $H_{Hj}(z)$ and a low cut-off frequency, as shown in FIG. 16. With this low-pass filter unit, an envelope signal Rj(n) is obtained from the digital voice signal $Q_j(n)$.

The characteristics of the high-pass filter unit having the transfer function $H_1(z)$ and the low-pass filter units having transfer functions $H_{2t}(z)$ and $H_{Hj}(z)$ will be described below.

Figure 17:
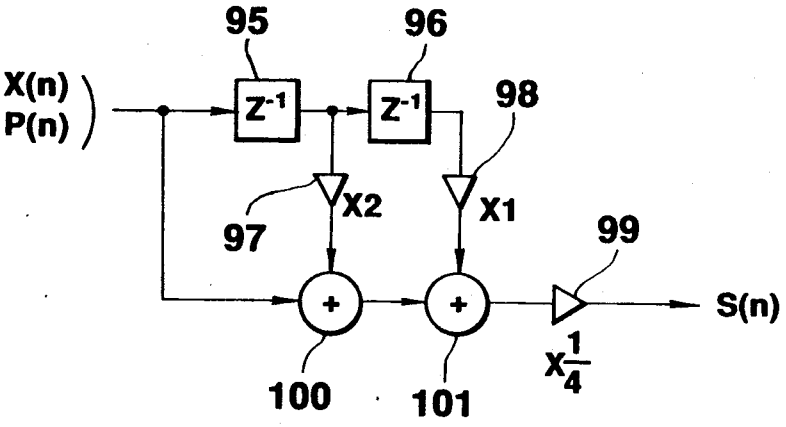
FIG. 17 is a diagram showing an arrangement of a high-pass filter $H_1(z)$ shown in FIG. 16.

FIG. 17 is a diagram showing the high-pass filter $H_1(z)$ as hardware. FIG. 17 illustrates a secondary FIR digital filter, and its transfer function is given by:

$$H_1(z)=(\tfrac{1}{4})(1-2z^{-1}+z^{-2})$$

In FIG. 17, reference numerals 95 and 96 denote delay elements; 97, 98 and 99, multipliers; and 100 and 101, adders. In the DSP 73 (FIG. 13 or 14), filter arithmetic processing equivalent to the high-pass filter of the arrangement shown in FIG. 17 is realized by the following discrete arithmetic processing:

For the BPF unit 90 (FIG. 15), $$S(n)=(\tfrac{1}{4})(x(n)-2x(n-1)+x(n-2)) \quad (1)$$

For the BPF unit 91 (FIG. 15), $$S(n)=(\tfrac{1}{4})(p(n)-2p(n-1)+p(n-2)) \quad (2)$$

Note that, since the filter coefficient is a multiple of 2, a multiplication of the coefficient and the signal can be realized by simple bit-shift processing.

Frequency characteristics of this high-pass filter are expressed by:

$$\begin{aligned}|H_1(e^{j\Omega})|^2 &= (1/16)|1-2e^{-j\Omega}+e^{-2j\Omega}|^2\\ &= (1/16)(6+2\cos 2\Omega-8\cos\Omega)\end{aligned}$$

Figure 18:
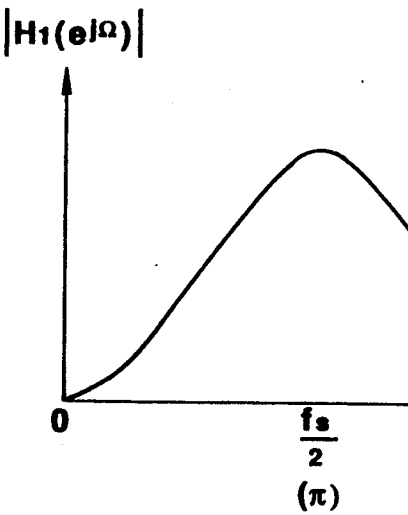
FIG. 18 is a graph showing characteristics of the high-pass filter $H_1(z)$ shown in FIG. 17.

When $\Omega=0$ (0 Hz), the frequency characteristics have a minimum value, and when $\Omega=\pi(f_s/2$ Hz), they have a maximum value. $f_s$ is the sampling frequency of the digital musical tone signal x(n) and the digital voice signal p(n). FIG. 18 shows the characteristics of the high-pass filter.

Figure 19:
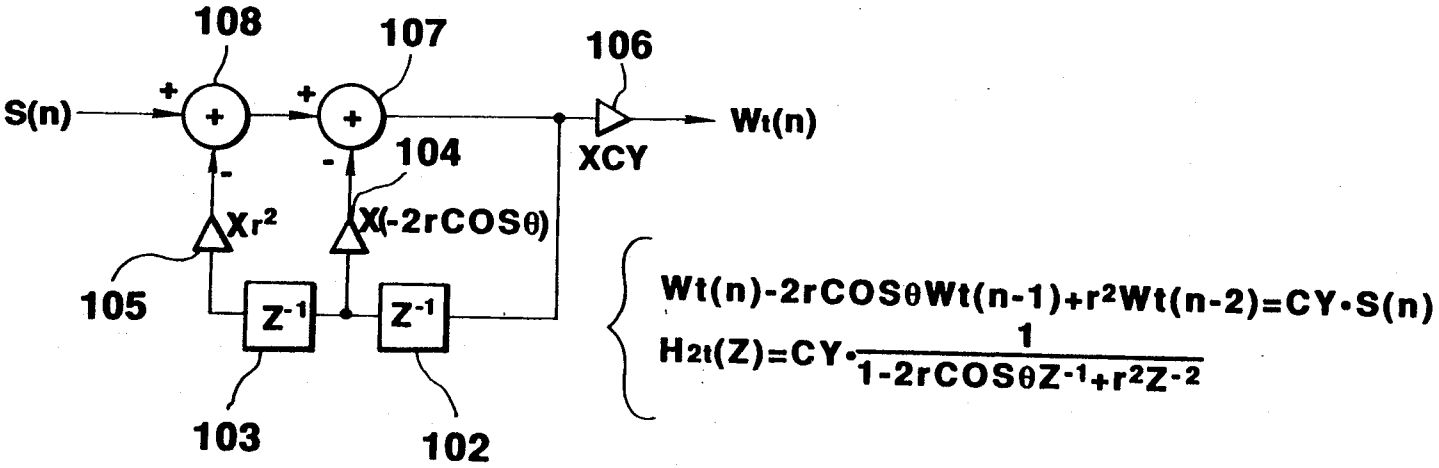
FIG. 19 is a diagram showing an arrangement of a low-pass filter $H_{2r}(z)$ shown in FIG. 16.

FIG. 19 is a diagram showing the low-pass filter $H_{2t}(z)$ shown in FIG. 16 as hardware. This filter is a secondary IIR digital filter, and its transfer function is expressed by:

$$H_{2t}(z) = CY\cdot\frac{1}{1-2r\cos\theta Z^{-1}+r^2Z^{-2}}$$

As will be described later, $\theta$ and CY are changed depending on a suffix t of each frequency-range conversion unit $89_t$ shown in FIG. 15, and r serves as a parameter indicating a strength of resonance (a peak level).

In FIG. 19, reference numerals 102 and 103 denote delay elements; 104, 105, and 106, multipliers; and 107 and 108, adders. In the DSP 73 (FIG. 13 or 14), filter arithmetic processing equivalent to the low-pass filter of the arrangement shown in FIG. 19 is realized by discrete arithmetic processing given by:

$$W_t(n) = CY\cdot S(n) + 2r\cos\theta W_t(n-1) - r^2W_t(n-2) \quad (3)$$

$$H_{2t}(e^{j\Omega}) = CY\cdot\frac{1}{1-2r\cos\theta e^{-j\Omega}+r^2e^{-2j\Omega}} - CY\cdot\frac{1}{\{1-(re^{j\theta})e^{-j\Omega}\}+\{1-(re^{-j\theta})e^{-j\Omega}\}}$$

Figure 20:
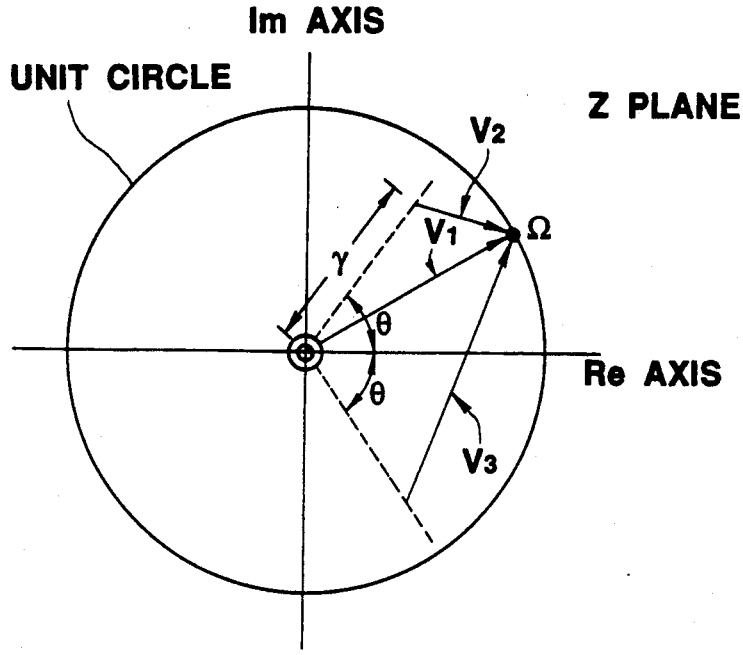
FIG. 20 is a chart showing poles, a zero point, and the relationship between a polar vector and a zero vector of the low-pass filter $H_{2r}(z)$ shown in FIG. 19.
Figure 21:
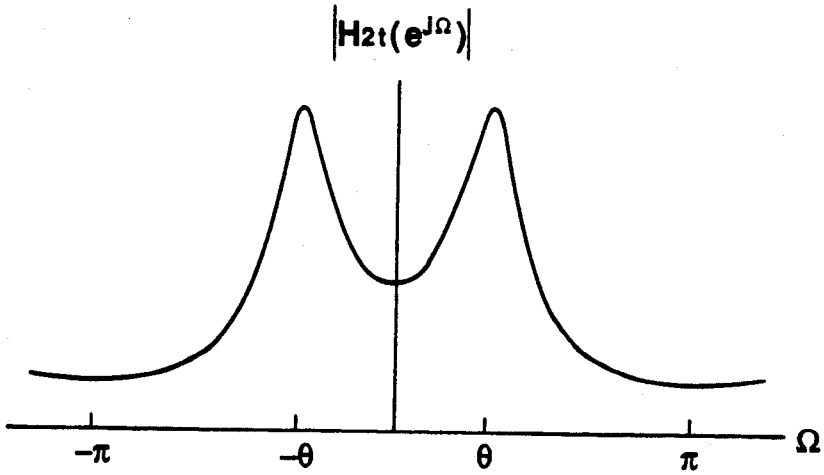
FIG. 21 is a graph showing amplitude characteristics of the low-pass filter $H_{2r}(z)$ shown in FIG. 19.

The poles of the transfer function are present at $z_1=re^{j\theta}$ and $z_2=re-^{j\theta}$, and a double zero point is present at z=0. FIG. 20 shows the arrangement of the poles and the zero point, and the relationship between a polar vector and a zero-point vector when $0<\theta<\pi/2$. As can be understood from FIG. 20, as $\Omega$ is moved along a unit circle from $\Omega=0$ toward $\Omega=\pi$, the magnitude of a minimum vector $v_2$ is near the pole ($re^{\theta j}$). It is known that the magnitude of a frequency response at a frequency $\Omega$ is defined by a ratio of the magnitudes of the zero-point vector $v_1$ and the polar vector $v_2$, and the phase of the frequency response becomes a value obtained by subtracting an angle defined by a real axis and the polar vector $v_2$ from an angle defined by the real axis and the zero-point vector $v_1$. FIG. 21 shows amplitude characteristics in this case. More specifically, the magnitude (amplitude characteristics) of the frequency response is proportional to a reciprocal number of the magnitude of the polar vector $v_2$, and becomes maximum at $\Omega$ near $\theta$. The sharpness of this peak is determined according to the magnitude of r, and a filter having a steep peak (resonance characteristics) can be realized by approaching r to 1.

Figure 22:
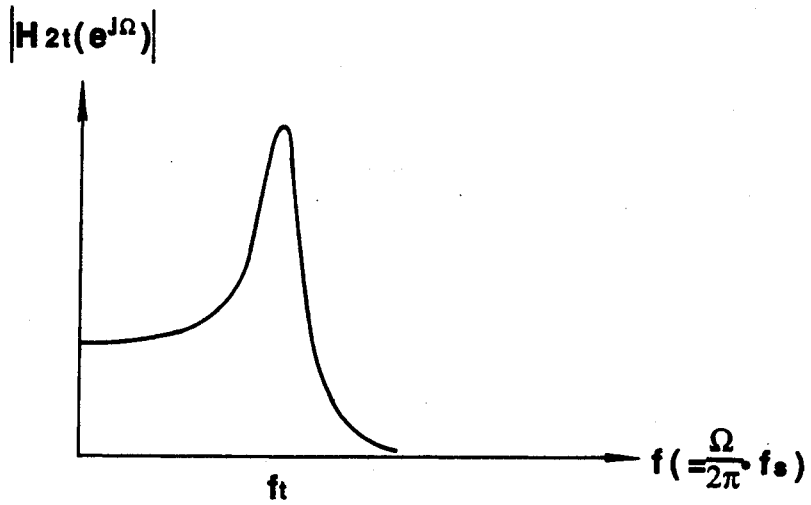
FIG. 22 is a graph showing characteristics of the low-pass filter $H_{2r}(z)$ shown in FIG. 19.

As can be seen from the above description, if a value $\theta$ can be determined in correspondence with the respective frequency-range conversion units $89_t(\theta=2\pi f_t/f_s)$, a low-pass digital filter with resonance having a peak at the center frequency $f_t$ of each frequency range can be realized, as shown in FIG. 22.

In this case, it is possible based on experiences or mathematically to obtain r to have a magnitude not to influence adjacent frequency ranges, and to obtain CY to have an output $W_t(n)$ having the same level in each frequency range. For example, if a ratio of the magnitude of a frequency response at the center frequency $f_t$ of a given frequency range to that at a center frequency $f_t+\Delta f$ of an adjacent frequency range separated by $\Delta f$ (i.e., $f_{t+1}$) is expressed by m : 1, the following quartic equation for r is solved, and r satisfying $0<r<1$ is selected to obtain coefficients $-2r\cos\theta$ and $r^2$:

$$|h_{2t}(e^{j2\pi f/f_s})|^2/|H_{2t}(e^{j2\pi(f+\Delta f)/f_s})|^2=m^2$$

As a result of numeric calculations, for example, if the sampling frequency $f_s=5$ kHz, f=440 Hz, and m=4, then $-2r\cos\theta=-1.9773$, $r^2=0.9851$, and CY =36.7. The same applies to other frequency ranges.

Figure 23:
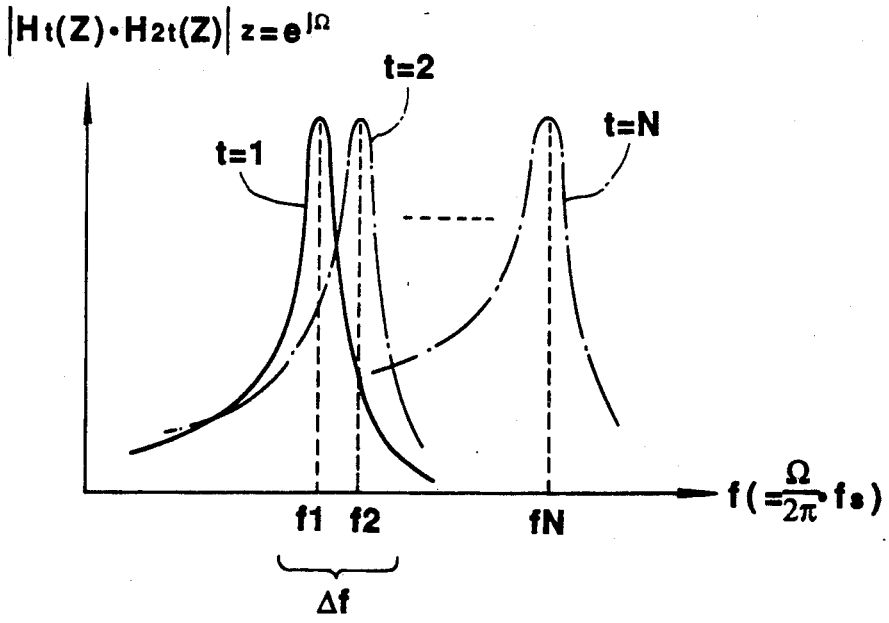
FIG. 23 is a graph showing characteristics of a band-pass filter $H_1(z) \cdot H_{2r}(z)$ shown in FIG. 16.

When the high-pass filter having the transfer function $H_1(z)$ and the low-pass filter having the transfer function $H_{2t}(z)$ are cascade-connected, as shown in FIG. 16, pseudo band-pass filters having center frequencies $f_1$ to $f_H$ and a frequency difference $\Delta f$ between adjacent frequency ranges can be realized by the overall transfer function expressed as a product of these transfer functions in units of frequency ranges t=1 to t=H, as shown in FIG. 23.

Figure 24:
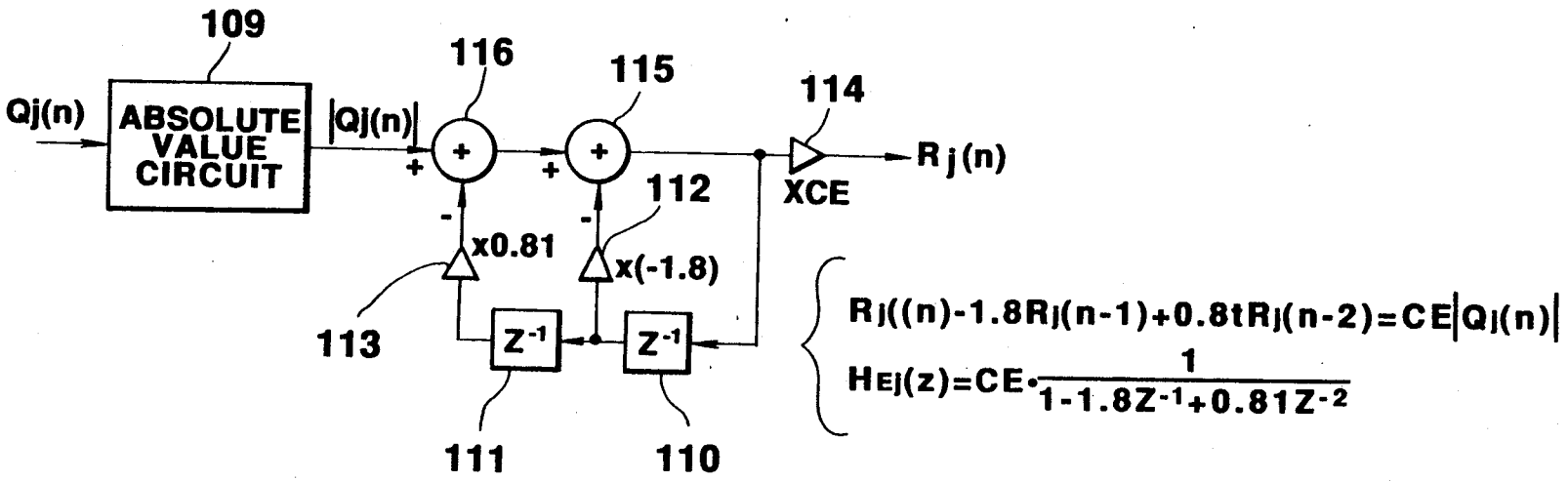
FIG. 24 is a diagram showing an arrangement of a low-pass filter $H_{Hj}(z)$ shown in FIG. 16.

FIG. 24 is a diagram showing the low-pass filter $H_{Ej}(z)$ shown in FIG. 16 corresponding to the envelope extraction unit 92 shown in FIG. 15 as hardware. This filter is the same secondary IIR digital filter as the low-pass filter $H_{2t}(z)$ described above, and its transfer function is given by:

$$H_{Ej}(z) = CE \cdot \frac{1}{1 - 1.8z^{-1} + 0.81z^{-2}}$$

In this transfer function, r=0.9 and $\theta=0$ are substituted in the transfer function of the low-pass filter $H_{2t}(z)$ described above.

In FIG. 24, reference numeral 109 denotes an absolute value circuit for converting the output $Q_j(n)$ of the BPF 91 shown in FIG. 15 as the output $W_t(n)$ of the low-pass filter $H_{2t}(z)$ shown in FIG. 16 into an absolute value, and its output $|Q_j(n)|$ is subjected to digital filtering. Reference numerals 110 and 111 denote delay elements; 112, 113, and 114, multipliers; and 115 and 116, adders. In the DSP 73 (FIG. 13 or 14), filter arithmetic processing equivalent to the low-pass filter of the arrangement shown in FIG. 24 is realized by discrete arithmetic processing given by:

$$Rj(n)=CE|Q_j(n)|+1.8Rj(n-1)-0.81Rj(n-2) \quad (4)$$

Figure 25:
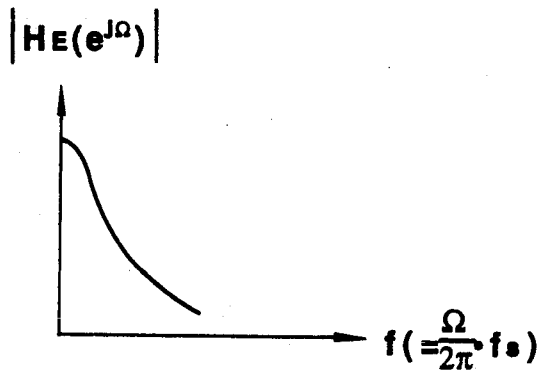
FIG. 25 is a graph showing characteristics of the low-pass filter $H_{Hj}(z)$ shown in FIG. 24.

As can be apparent from the above description, this low-pass filter is one with resonance having a peak at $\theta=0$, and has frequency characteristics (amplitude characteristics) shown in FIG. 25. In this case, a cut-off frequency is lower than that of the low-pass filter $H_{2t}(z)$ in a lowest frequency range. In this case, a coefficient CE is a coefficient for uniforming levels in the respective frequency ranges, and is appropriately obtained based on experiences.

Figure 26:
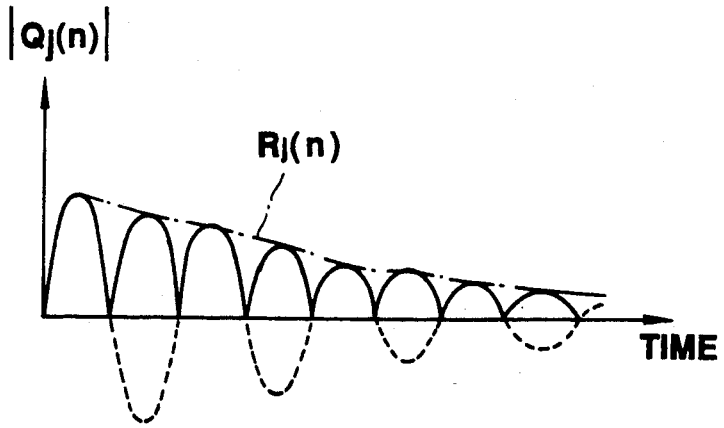
FIG. 26 is a chart showing the relationship between $|Qj(n)|$ and $Rj(n)$.

FIG. 26 shows an envelope signal $R_j(n)$ obtained by the above-mentioned principle in comparison with an input $|Q_j(n)|$. After all the negative peak values (broken curves in FIG. 26) are converted to positive peak values by calculations corresponding to the absolute value circuit 109 shown in FIG. 24, the low-pass filtering processing is executed. As a result, an operation for obtaining a DC component of the digital voice signal $|Q_j(n)|$ subjected to frequency-range limitation is executed by the envelope extraction unit 92 shown in FIG. 15.

An operation performed when the filter functions shown in FIGS. 15 to 26 are executed by software processing on the DSP 73 shown in FIG. 13 o 14 will be described below.

Figure 27:
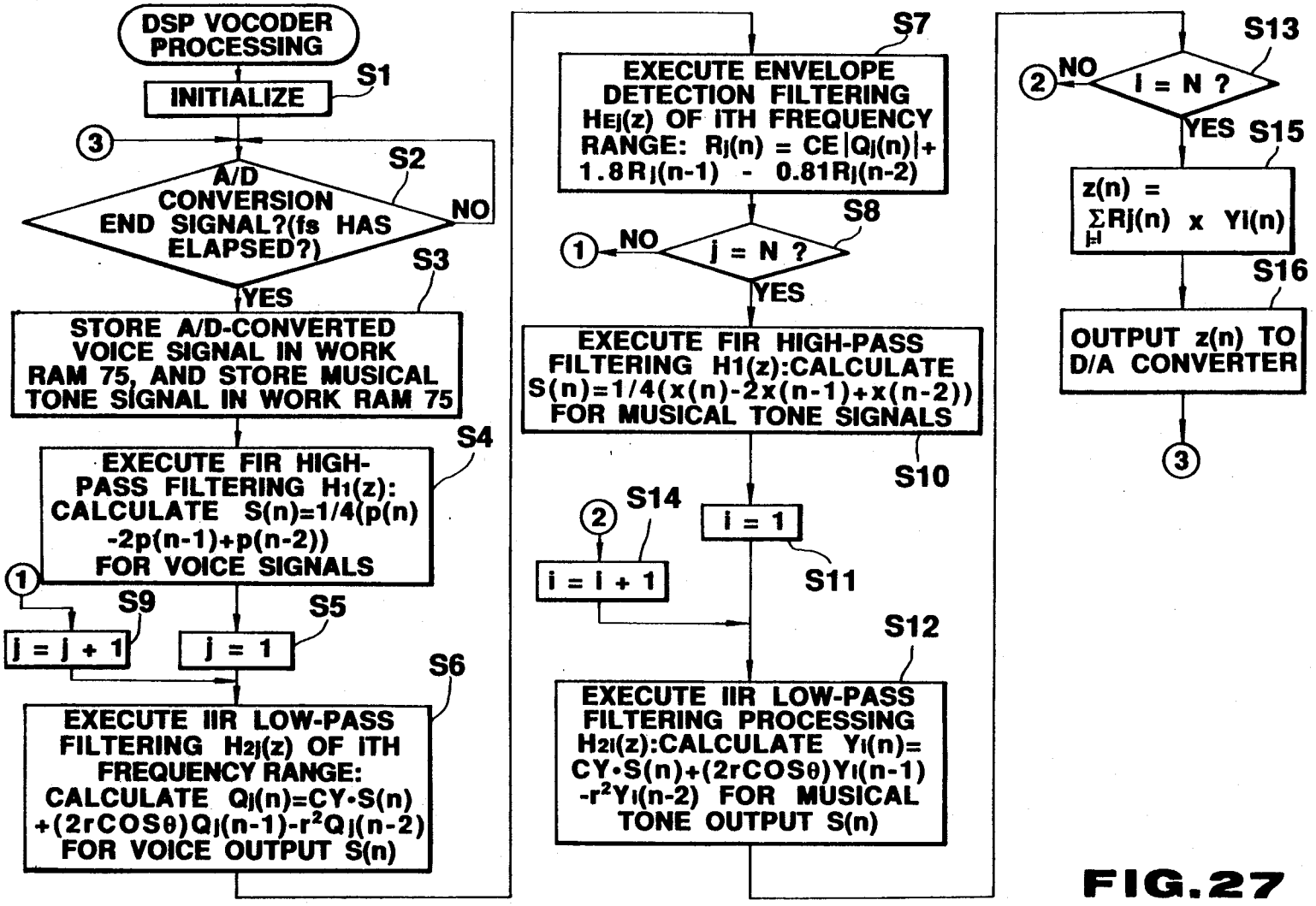
FIG. 27 is a flow chart showing an operation of DSP vocoder processing shown in FIG. 13.

FIG. 27 is an operation flow chart of band-pass filter processing and low-pass filter processing for extracting an envelope, which are executed according to a microprogram stored in the operation ROM 732 (FIG. 14), that is, DSP vocoder processing. With this filter processing corresponding to the BPF units 90 and 91, the envelope extraction unit 92, and the multiplier unit 93 in each frequency-range conversion unit $89_t$ (t=1 to N) in each frequency range shown in FIG. 15, and processing corresponding to the accumulation unit 99 are executed as time-divisional processing for each sampling period common to the digital musical tone signal x(n) and the digital voice signal p(n), thereby obtaining the digital output musical tone signal z(n) for each sampling period. The obtained signal is output to the D/A converter 77 shown in FIG. 13.

In FIG. 27, the content of the work RAM 75 (FIG. 13 or 14) or the like is initialized ($S_1$).

An A/D conversion end signal which is generated from the A/D converter 83 shown in FIG. 13 for every predetermined time period corresponding to the sampling frequency $f_s$ is waited ($S_2$). The A/D-converted digital voice signals p(n) are fetched from the interface 731 (FIG. 14) at respective sampling timings, and are sequentially stored in the work RAM 75. At the same time, the digital musical tone signals x(n) input from the musical tone generation circuit 76 (FIG. 13) are fetched from the interface 731, and are sequentially stored in the work RAM 75. The work RAM 75 can store the present sample and two previous samples.

Processing in steps $S_4$ to $S_9$ in FIG. 27 corresponds to processing of the BPF unit 91 and the envelope extraction unit 92 in each of the frequency-range conversion units $89_1$ to $89_N$ shown in FIG. 15.

More specifically, the present digital voice signal and digital voice signals corresponding to two previous samples are read out to registers p(n), p(n−1), and p(n−2) in the register group 737, and high-pass filtering processing expressed by the transfer function H1(z) (FIG. 16) as a part of processing corresponding to the BPF unit 91 (FIG. 15) is executed ($S_4$). This processing is arithmetic processing given by equation (2) described above, and is executed using the multiplier 735 and the adder/subtracter 736 shown in FIG. 14. In this case, filter coefficients used in the calculations of equation (2) are read out from the filter coefficient ROM 74 (FIG. 13 or 14), and are used in calculations. The obtained output is stored in a register S(n) in the register group 737. This high-pass filtering processing need only be executed once since it is common to the respective frequency ranges.

Low-pass filtering processing expressed by the transfer function $H_{2i}(z)=H_{2j}(z)$ (FIG. 16) as the remaining processing corresponding to the BPF unit 91 (FIG. 15), and low-pass filtering processing expressed by the transfer function $H_{Ei}(z)=H_{Ej}(z)$ (FIG. 16) corresponding to the envelope extraction unit 92 are successively executed. These processing operations are repeated as time-divisional processing operations for N frequency ranges in correspondence with the frequency-range conversion units $89_1$ to $89_N$. For this reason, a repetition control register j for performing time-divisional processing for N frequency ranges is allocated on the register group 737, and is initialized to a value "1" in step S5. Every time low-pass filtering processing for one frequency range in steps $S_6$ and $S_7$ is completed, it is checked in step $S_8$ if the content of the register j reaches N. If NO in step $S_8$, the content of the register j is incremented in step $S_9$, and step $S_6$ is then repeated. This processing is executed by the adder/subtracter 736 and the flag register 738 (FIG. 14), and the address counter 733 repetitively reads out program instructions corresponding to steps $S_6$ and $S_7$ from the operation ROM 732.

The low-pass filtering processing expressed by the transfer function $H_{2i}(z)=H_{2j}(z)$ (FIG. 16) is executed for the content of the register S(n) as the output of the above-mentioned high-pass filtering processing ($S_6$) This processing is arithmetic processing expressed as $W_i=Qj$ in equation (3) described above (FIG. 16), and is executed using the multiplier 735 and the adder/subtracter 736 (FIG. 14). Filter coefficients used in the arithmetic processing of equation (3) are read out from the filter coefficient ROM 74, and are used in calculations. Registers $Q_j(n-1)$ and $Q_j(n-2)$ for storing own filter outputs for two previous samples are allocated on the register group 737, and their contents are used in the above-mentioned calculations. The obtained output is stored in a register $Q_j(n)$ in the register group 737. Note that the registers $Q_j(n)$, $Q_j(n-1)$, and $Q_j(n-2)$ are provided for N frequency ranges by changing their suffix j.

The low-pass filtering processing expressed by the transfer function $H_{Ei}(z)=H_{Ej}(z)$ (FIG. 16) is executed for the content of the register $Q_j(n)$ as the output of the above-mentioned low-pass filtering processing ($S_7$). This processing is arithmetic processing expressed by multiplier 735 and the adder/subtracter 736 (FIG. 14). In this case, filter coefficients used in the arithmetic processing of equation (4) are read out from the filter coefficient ROM 74. Registers $R_j(n-1)$ and $R_j(n-2)$ for storing own filter outputs for two previous samples are allocated on the register group 737, and their contents are used in the above-mentioned calculations. Note that the registers $R_j(n)$, $R_j(n-1)$, and $R_j(n-2)$ are provided for N frequency ranges by changing their suffix j.

With the processing in steps $S_5$ to $S_9$ in FIG. 27, the processing corresponding to the BPF unit 91 and the envelope extraction unit 92 in each of the frequency-range conversion units $89_1$ to $89_N$ for N frequency ranges in FIG. 15 is executed.

Subsequently, processing in steps $S_{10}$ to $S_{13}$ in FIG. 27 corresponds to processing of the BPF unit 90 in each of the frequency-range conversion units $89_1$ to $89_N$ in FIG. 15.

More specifically, digital musical tone signals corresponding to the present sample and the two previous samples are read out to registers x(n), x(n−1), and x(n−2) in the register group 737 (FIG. 14). A high-pass filtering processing expressed by the transfer function $H_1(z)$ (FIG. 16) as a part of processing corresponding to the BPF unit 90 (FIG. 15) is executed ($S_{10}$ in FIG. 27). This processing is arithmetic processing expressed by equation (1) described above, and is executed using the multiplier 735 and the adder/subtracter 736 shown in FIG. 14. In this case, filter coefficients used in calculations of equation (1) are read out from the filter coefficient ROM 74. The obtained output is stored in the register S(n) in the register group 737. The high-pass filtering processing need only be executed once since it is common to the respective frequency ranges.

Then, low-pass filtering processing expressed by the transfer function $H_{2i}(z)=H_{2i}(z)$ (FIG. 16) as the remaining processing corresponding to the BPF unit 90 (FIG. 15) is executed. This processing is repeated as time-divisional processing for N frequency ranges in correspondence with the frequency-range conversion units $89_1$ to $89_N$ in FIG. 15. For this purpose, a repetition control register i for performing time-divisional processing for N frequency ranges is allocated on the register group 737, and is initialized to a value "1" in step $S_{11}$. Every time low-pass filtering processing for one frequency range in step $S_{12}$ is completed, it is checked in step $S_{13}$ if the content of the register i reaches N. If NO in step $S_{13}$, the content of the register i is incremented in step $S_{14}$, and step $S_{12}$ is then repeated. In this case, the circuits shown in FIG. 14 are operated in the same manner as in the register j described above.

The processing in step S12 is substantially the same as that in step $S_6$ described above. More specifically, arithmetic processing expressed as $W_i=Y_i$ in equation (3) described above is executed for the content of the register S(n) as the output of the high-pass filtering processing (FIG. 16). In this case, registers $Y_i(n-1)$ and $Y_i(n-2)$ storing own filter outputs for two previous samples are allocated on the register group 737, and their contents are used in the above-mentioned calculations. The obtained output is stored in a register $Y_i(n)$ in the register group 737. Note that the registers $Y_i(n)$, $Y_i(n-1)$. and $Y_i(n-2)$ are provided for N frequency ranges by changing their suffix i.

With the processing in steps $S_{10}$ to $S_{13}$ in FIG. 27, the processing corresponding to the BPF unit 90 in each the frequency-range conversion units $89_1$ to $89_N$ for N frequency ranges in FIG. 15 is executed.

In steps $S_4$ to $S_{13}$, the contents of the registers $R_j(n)$ and $Y_i(n)$ corresponding to the outputs of the envelope extraction unit 92 and the BPF unit 90 (FIG. 15) are determined. Using these contents, the following processing corresponding to the multiplier unit 93 and the accumulation unit 94 in each of the frequency-range conversion units $89_1$ to $89_N$ for N frequency ranges (FIG. 15) is executed. More specifically, in step $S_{15}$ in FIG. 27, a multiplication of $R_j(n)\times Y_i(n)$ is executed while changing the content of the registers i=j from 1 to N. This processing is executed using the multiplier 735 in FIG. 14. The products are then accumulated. This processing is executed using the adder/subtracter 736 (FIG. 14).

The accumulation result obtained as described above is stored in a register z(n) in the register group 737 (FIG. 14), and is then output from the interface 731 (FIG. 14) to the D/A converter 77 (FIG. 13) at a predetermined sampling interval in step $S_{16}$ in FIG. 27.

According to the embodiment as described above, processing of the BPF units 90 and 91 (FIG. 15) for dividing the musical tone signal and the human voice signal into a plurality of frequency ranges, processing of the envelope extraction unit 92 (FIG. 15) for extracting an envelope signal from the frequency-range limited voice signal, processing of the multiplier unit 93 (FIG. 15) for amplitude-modulating the frequency-range limited musical tone signal, and processing of the accumulation unit 94 (FIG. 15) for accumulating the modulated outputs in the respective frequency ranges to obtain an output musical tone signal are realized as digital filter processing by time-divisional software processing. Thus, effect addition processing for adding a nuance of a human voice to a harmonic overtone component of an instrument tone can be easily and stably performed by a one-chip DSP.

In the above embodiment, the digital musical tone signal and the digital voice signal are divided into the same frequency ranges and are processed. Alternatively, musical tone signals obtained by dividing the digital musical tone signal into given frequency ranges may be modulated by envelope signals obtained by dividing the digital voice signal into other frequency ranges, thus obtaining an interesting effect.

In the operation flow chart in FIG. 27, the same sampling frequency is used for the digital musical tone signal and the digital voice signal. When these signals are sampled at different sampling frequencies, the sampled signals are stored in memories by interrupt processing, and processing can be executed for these signals at predetermined time intervals, so that the same effect as in the above embodiment can be easily realized. In this case, the frequency ranges of the band-pass filters are appropriately set.

If there is a margin in processing of the DSP, the arithmetic processing of the band-pass filter may be realized not by arithmetic processing as a combination of the high-pass filter and the low-pass filter but by arithmetic processing programmed based on a result of a direct design of the transfer function of the band-pass filter.

Additional advantages and modifications will readily occur to those skilled in the art. Therefore, the invention in its broader aspects is not limited to the specific details, and representative devices, shown and described herein. Accordingly, various modifications may be without departing from the spirit or scope of the general inventive concept as defined by the appended claims and their equivalents.

What is claimed is:

1. An automatic performance apparatus comprising:

note designation means for sequentially and automatically designating a note on the basis of prestored data of a music piece, without any external operation;

musical tone signal generation means for sequentially outputting a musical tone signal including harmonic frequency components on the basis of the note designated by said note designation means as a fundamental frequency;

external voice detection means for detecting an external voice and for producing a voice signal; and modulation means for dividing the voice signal received from said external voice detection means into voice signals in a plurality of frequency ranges, and for modulating the musical tone signal in units of corresponding frequency ranges on the basis of the voice signals divided in top the plurality of frequency ranges, thereby modulating at least timbre of the musical tone signal to be outputted on the basis of the voice signals divided into the plurality of frequency ranges.

2. An apparatus according to claim 1, wherein said note designation means designates a melody note and an accompaniment note of a music piece, and said musical tone signal generation means outputs a melody tone signal and an accompaniment tone signal on the basis of the designated melody note and the accompaniment note.

3. An apparatus according to claim 2, wherein said modulation means modulates the melody tone signal in units of corresponding frequency ranges on the basis of the voice signals obtained by dividing the voice signal from said external voice detection means into the plurality of frequency ranges.

4. An apparatus according to claim 2, further comprising selection means for selecting a desired one of the melody tone signal and the accompaniment tone signal output form said musical tone signal generation means, and for supplying the selected signal to said modulation means.

5. An apparatus according to claim 1, wherein said modulation means comprises:

a plurality of band-pass filter means for dividing the musical tone signal from said musical tone signal generation means and the external voice signal from said external voice detection means into signals in units of frequency ranges, and for outputting the divided signals;

a plurality of envelope extraction means for extracting envelope signals from the divided external voice signals output from said band-pass filter means;

plurality of voltage-controlled variable means for receiving the divided musical tone signals output from said band-pass filter means, and for varying the input musical tone signals in correspondence with the envelope signals from said envelope extraction means; and mixer means for mixing the output signals from said plurality of voltage-controlled variable means, and for outputting a mixed signal.

6. An apparatus according to claim 5, wherein said modulation means further comprises:

white noise generation means for generating a white noise signal; and addition means for adding the white noise signal from said white noise generation means and the musical tone signal from said musical tone signal generation means, and for supplying a sum signal to said band-pass filter means.

7. An apparatus according to claim 5, wherein each of said voltage-controlled variable means comprises a voltage-controlled amplifier.

8. An apparatus according to claim 5, wherein said modulation means further comprises:

level detection means for detecting that an external voice signal level from said external voice detection means is decreased below a predetermined level, and for outputting a signal; and gate means, responsive to the signal outputted from said level detection means, for supplying the musical tone signal from said musical tone signal generation means to said mixer means.

9. An apparatus according to claim 1, wherein said modulation means modulates the musical tone signals in units of corresponding frequency ranges on the basis of only the voice signals divided into the plurality of frequency ranges, thereby modulating at least timbre of the musical tone signal to be outputted on the basis of only the voice signals divided into the plurality of frequency ranges.

10. An automatic performance apparatus comprising:

musical tone signal generation means for sequentially and automatically outputting a musical tone signal on the basis of restored data of a music piece, without any external operation;

external voice detection means for detecting an external voice and for producing a voice signal; and modulation means for modulating at least timbre of the musical tone signal on the basis of the voice signal from said external voice detection means, and for outputting the modulated signal having at least said timbre modulated on the basis of said voice signal from said external voice detection means.

11. An apparatus according to claim 10, wherein said modulation means modulates at least timbre of the musical tone signal on the basis of only the voice signal from said external voice detection means, whereby the outputted modulated signal has at least said timbre modulated on the basis of only said voice signal from said external voice detection means.

12. An apparatus according to claim 10, wherein said musical tone signal generation means outputs a melody tone signal and an accompaniment tone signal of the music piece as the musical tone signal.

13. An apparatus according to claim 12, wherein said modulation means modulates the melody tone signal from said musical tone signal generation means on the basis of the voice signal from said external voice detection means.

14. An apparatus according to claim 12, further comprising selection means for selecting a desired one of the melody tone signal and the accompaniment tone signal output form said musical tone signal generation means, and for supplying the selected signal to said modulation means.

15. An apparatus according to claim 10, wherein said modulation means comprises:

a plurality of band-pass filter means for dividing the musical tone signal form said musical tone signal generation means and the external voice signal form said external voice detection means into signals in units of frequency ranges, and for outputting the divided signals;

a plurality of envelope extraction means for extracting envelope signals form the divided external voice signals output from said band-pass filter means;

a plurality of voltage-controlled variable means for receiving the divided musical tone signals output form said band-pass filter means, and for varying the input musical tone signals in correspondence with the envelope signals form said envelope extraction means; and mixer means for mixing the output signals form said plurality of voltage-controlled variable means, and for outputting a mixed signal.

16. An apparatus according to claim 10, wherein said modulation means comprises:

a plurality of band-pass filter means for dividing the musical tone signal form said musical tone signal generation means and the external voice signal form said external voice detection means into signals in units of frequency ranges, and for outputting the divided signals;

a plurality of voltage-controlled variable means for varying the divided musical tone signals output form said band-pass filter means in correspondence with the envelope signals form said envelope extraction means; and mixer means for mixing the output signals from said plurality of voltage-controlled variable means, and for outputting a mixed signal.

17. An apparatus according to claim 10, wherein said modulation means further comprises:

white noise generation means for generating a white noise signal; and addition means for adding the white noise signal from said white noise generation means and the musical tone signal from said musical tone signal generation means, and for supplying a sum signal to said band-pass filter means.

18. An apparatus according to claim 10, wherein said modulation means comprises a voltage-controlled amplifier.

19. An apparatus according to claim 10, wherein said modulation means comprises multiplication means for multiplying the musical tone signal form said musical tone signal generation means with the external voice signal from said external voice detection means.

20. An apparatus according to claim 10, wherein said modulation means further comprises:

level detection means for detecting that an external voice signal level from said external voice detection means is decreased below a predetermined level, and for outputting a signal; and gate means, responsive to the signal from said lever detection means, for supplying the musical tone signal form said musical tone signal generation means to said mixer means.

21. A musical tone generating apparatus comprising:

note designation means for designating a note;

musical tone signal generation means for simultaneously outputting a first musical tone signal including harmonic frequency components in a wide frequency range and a second musical tone signal including harmonic frequency components in a specific frequency range on the basis of the note designated by said note designation means as a fundamental frequency;

external voice detection mans for detecting an external voice;

first modulation means for dividing the voice signal from said external voice detection means into voice signals in units of a plurality of frequency ranges, for modulating the first musical tone signal in units of the corresponding frequency ranges on the basis of the divided voice signals in the plurality of frequency ranges, and for outputting the modulated signals;

second modulation means for modulating the second musical tone signal output form said musical tone signal generation means on the basis of the voice signal from said external voice detection means; and tone generation means for generating a tone on the basis of a signal obtained by mixing the musical tone signals modulated by said first and second modulation means.

22. An apparatus according to claim 21, wherein said first modulation means comprises:

a plurality of band-pass filter means for dividing the musical tone signal from said musical tone signal generation means and the external voice signal form said external voice detection means into signals in units of frequency ranges, and for outputting the divided signals;

a plurality of envelope extraction means for extracting envelope signals form the divided external voice signals output from said band-pass filter means;

a plurality of voltage-controlled variable means for receiving the divided musical tone signals output from said band-pass filter means, and for varying the input musical tone signals in correspondence with the envelope signals from said envelope extraction means; and mixer means for mixing the output signals form said plurality of voltage-controlled variable means, and for outputting a mixed signal.

23. An apparatus according to claim 22, wherein each of said voltage-controlled variable means comprises a voltage-controlled amplifier.

24. A musical instrument comprising:

note designation means for designating a note;

musical tone signal generation means for simultaneously outputting a first musical tone signal including harmonic frequency components in a wide frequency range and a second musical tone signal including harmonic frequency components in a specific frequency range on the basis of the note designated by said note designation means as a fundamental frequency;

first mixer means for mixing the first and second musical tone signals, and for outputting the mixed signal;

external voice detection means for detecting an external voice;

modulation means for dividing the voice signal from said external voice detection means into vice signals in units of a plurality of frequency ranges, for modulating the musical tone signal mixed by said first mixer means in units of the corresponding frequency ranges on the basis of the divided voice signals in the plurality of frequency ranges, and for outputting the modulated signals; and tone generation means for generating a tone on the basis of the musical tone signal modulated by said modulation means.

25. An apparatus according to claim 24, wherein said modulation means comprises:

a plurality of band-pass filter means for dividing the musical tone signal form said first mixer means and the external voice signal form said external voice detection means into signals in units of frequency ranges, and for outputting the divided signals;

a plurality of envelope extraction means for extracting envelope signals from the divided external vice signals output from said band-pass filter means;

a plurality of voltage-controlled variable means for receiving the divided musical tone signals output from said band-pass filter means, and for varying the input musical tone signals in correspondence with the envelope signals from said envelope extraction means; and second mixer means for mixing the output signals from said plurality of voltage-controlled variable means, and for outputting a mixed signal.

26. An apparatus according to claim 25, wherein each of said voltage-controlled variable means comprises a voltage-controlled amplifier.

27. An electronic musical apparatus comprising:

first digital filtering processing means for dividing a digital musical tone signal into musical tone signals which are frequency-range limited to a plurality of different frequency ranges;

second digital filtering processing means for dividing a digital voice signal into voice signals which are frequency-range limited to a plurality of different frequency ranges;

envelope extraction processing means for extracting envelope signals from the frequency-range limited voice signals obtained by said second digital filtering processing means;

modulation processing means for modulating the frequency-range limited musical tone signals obtained by said first digital filtering processing means according to the envelope signals obtained by said envelope extraction processing means; and accumulation processing means for accumulating the modulated signals obtained by said modulation processing means, and for outputting an accumulated signal as a digital output musical tone signal.

28. An apparatus according to claim 27, wherein said first and second digital filtering processing means perform band-pass filter processing for frequency-range limiting the inputs into the respective frequency ranges.

29. An apparatus according to claim 28, wherein said first and second digital filtering processing means perform sequentially and time-divisionally high-pass filtering processing and low-pass filtering processing added with resonance having peaks at center frequencies of the respective frequency ranges.

30. An apparatus according to claim 28, wherein said first and second digital filtering processing means perform sequentially and time-divisionally FI type high-pass filtering processing and IIR type low-pass filtering processing added with resonance having peaks at center frequencies of the respective frequency ranges.

31. An apparatus according to claim 27, wherein said envelope extraction processing means performs a low-pass filtering processing having a lower cut-off frequency than a center frequency of a lowest frequency range which is frequency-range limited by said first and second digital filtering means.

32. An apparatus according to claim 27, wherein said envelope extraction processing means performs low-pass filtering processing for allowing a frequency component near a DC component to pass therethrough.

33. An apparatus according to claim 27, wherein said modulation processing means multiplies the envelope signals obtained by said envelope extraction processing means with the musical tone signals frequency-range limited by said first digital filtering processing means.

34. A musical tone generating apparatus comprising:

musical tone signal generation means for generating a digital musical tone signal on the basis of a performance operation by a user;

voice signal generation means for generating a digital voice signal on the basis of a voice produced by a user;

digital signal processing means for sequentially executing first digital filtering processing for dividing the digital musical tone signal into musical tone signals which are frequency-range limited to a plurality of different frequency ranges, second digital filtering processing for dividing the digital voice signal into voice signals which are frequency-range limited to a plurality of different frequency ranges, envelope extraction processing for extracting envelope signals from the frequency-range limited voice signals obtained by the second digital filtering processing, modulation processing for modulating the frequency-range limited musical tone signals obtained by the first digital filtering processing according to the envelope signals obtained by the envelope extraction processing, and accumulation processing for accumulating the modulated signals obtained by the modulation processing and outputting an accumulated signal as a digital output musical tone signal by time-divisional digital signal processing; and sound producing means for converting the digital output musical tone signal output from said digital signal processing means into an analog output musical tone signal, and for producing a corresponding sound.

* * * * *